US005972289A

United States Patent [19]

Sikka et al.

[11] Patent Number: 5,972,289

[45] Date of Patent: Oct. 26, 1999

[54] HIGH STRENGTH, THERMALLY STABLE, OXIDATION RESISTANT, NICKEL-BASED ALLOY

[75] Inventors: Vinod K. Sikka, Oak Ridge, Tenn.; Seetharama C. Deevi, Midlothian, Va.; Joseph D. Vought, Rockwood; C. Randal Howell, Knoxville, both of Tenn.

[73] Assignee: Lockheed Martin Energy Research Corporation, Oak Ridge, Tenn.

[21] Appl. No.: 09/074,095

[22] Filed: May 7, 1998

[51] Int. Cl.[6] ..... C22C 19/03; C22C 19/05

[52] U.S. Cl. ..... 420/445; 420/441; 420/453; 148/429

[58] Field of Search ..... 420/445, 441, 420/453, 448, 450, 586.1; 148/429

[56] References Cited

U.S. PATENT DOCUMENTS

| | | | |
|---|---|---|---|
| 620,278 | 5/1899 | Flint | 420/453 |
| 3,615,376 | 10/1971 | Ross | 75/171 |
| 3,660,082 | 5/1972 | Negishi et al. | 75/134 |
| 3,785,809 | 1/1974 | Cox | 75/171 |
| 3,844,774 | 10/1974 | Culling | 75/134 F |
| 3,854,941 | 12/1974 | Morrow et al. | 75/171 |
| 4,259,111 | 3/1981 | Kadau et al. | 75/171 |
| 4,425,300 | 1/1984 | Teramoto et al. | 420/453 |
| 4,456,481 | 6/1984 | McGinniss | 75/82 |
| 4,692,305 | 9/1987 | Rangaswamy et al. | 420/436 |
| 4,762,681 | 8/1988 | Tassen et al. | 420/443 |
| 4,762,682 | 8/1988 | Klarstrom | 420/454 |
| 4,818,486 | 4/1989 | Rothman et al. | 420/442 |
| 5,068,084 | 11/1991 | Cetel et al. | 420/443 |
| 5,310,522 | 5/1994 | Culling | 420/585 |
| 5,330,711 | 7/1994 | Snider | 420/448 |
| 5,399,313 | 3/1995 | Ross et al. | 420/448 |
| 5,417,918 | 5/1995 | Kohler et al. | 420/443 |

FOREIGN PATENT DOCUMENTS

| | | | |
|---|---|---|---|
| 171645 | 10/1982 | Japan | 420/453 |
| 2129014 | 5/1984 | United Kingdom | 148/429 |

*Primary Examiner*—Deborah Yee

[57] ABSTRACT

A polycrystalline alloy is composed essentially of, by weight %: 15% to 30% Mo, 3% to 10% Al, up to 10% Cr, up to 10% Fe, up to 2% Si, 0.01% to 0.2% C, 0.01% to 0.04% B, balance Ni.

16 Claims, 19 Drawing Sheets

HIGH STRENGTH, THERMALLY STABLE, OXIDATION RESISTANT, NICKEL-BASED ALLOY

The United States Government has rights in this invention pursuant to contract no. DE-AC05-96OR22464 between the United States Department of Energy and Lockheed Martin Energy Research Corporation.

FIELD OF THE INVENTION

The present invention relates to nickel-based alloys, and more particularly to nickel-based alloys having major additions of Cr, Mo, and Al, and minor additions of C and B.

BACKGROUND OF THE INVENTION

Commercial production of many durable products, for example, automotive, aerospace, industrial, and appliances, etc, involve manufacturing methods which include hot forging, extrusion, cutting, etc. Forging and extrusion dies must be very robust in order to have an adequate service life. Dies are generally heat treated in order to obtain sufficient hardness to resist distortion during use in manufacturing processes. However, the hardness obtained by heat treating decreases with time as high temperature work pieces repeatedly come in contact with the die surface. Decreased hardness results in changes in the dimensions of the die due to deformation. Thus, the die must be replaced.

Some die materials have poor resistance to oxidation therefore build up surface oxide scale which alters the die cavity dimensions.

In cutting tool applications, hardened tools can lose their edge and/or performance due to softening which results from heating of the cutting edge by friction during contact with work pieces.

OBJECTS OF THE INVENTION

Accordingly, objects of the invention include a new nickel base alloy characterized by the following:

1. High hardness in the as-cast condition and, thus does not require heat treatments to achieve hardness.

2. Retention of die shape because alloy hardness is not reduced by long term exposures at temperatures in the range of 850 to 1000° C., the temperature range to which a die surface typically heats to during hot forging of steel work pieces that are at 1100 to 1200° C.

3. Long life and shape retention because alloy does not oxidize to any significant extent by exposure to air in the temperature range of 850 to 1000° C.

4. Suitability or inexpensive method of melting and casting into die shape without the requirement of expensive machining and heat treating steps.

5. Superior cutting tool and cutting edge performance under cutting conditions up to 1000° C.

Further and other objects of the present invention will become apparent from the description contained herein.

SUMMARY OF THE INVENTION

In accordance with one aspect of the present invention, the foregoing and other objects are achieved by a polycrystalline alloy which is composed essentially of, by weight %: 15% to 30% Mo, 3% to 10% Al, up to 10% Cr, up to 10% Fe, up to 2% Si, 0.01% to 0.2% C, 0.01% to 0.04% B, balance Ni.

In accordance with another aspect of the present invention, a polycrystalline alloy is composed essentially of, by weight %: 15% to 23% Mo, 3% to 6% Al, 7% to 9% Cr, 0.03% to 0.1% C, 0.01% to 0.04% B, balance Ni.

BRIEF DESCRIPTION OF THE DRAWING

In the drawing:

FIG. 11(*b*) is a graph showing room-temperature hardness as a function of time after heat treating at 900° C. for alloy B13.

FIG. 14(*b*) is a graph showing room-temperature hardness as a function of LM parameter. The LM parameter was used to combine the change in hardness due to exposure at various temperatures for alloy B9.

FIG. 28(*b*) is a graph showing weight change as a function of time for exposure in air at 900° C. for alloy B13.

FIG. 28(*c*) is a graph showing weight change as a function of time for exposure in air at 1000° C. for alloy B13.

For a better understanding of the present invention, together with other and further objects, advantages and capabilities thereof, reference is made to the following disclosure and appended claims in connection with the above-described drawings.

DETAILED DESCRIPTION OF THE INVENTION

Table 1 gives nominal alloy compositions of a variety of embodiments of the present invention. The alloys, designated by B1 through B13, are compared to a standard alloy known as Hastelloy B, designated as alloy B.

Compared to alloy B, alloys B1–B13 include removal of Co and Mn, additions of Al and B, replacement of Fe by Cr in some cases, and removal of Si in some cases. The Al addition resulted in several benefits:

1. Very large increase in as-cast hardness
2. Significant enhancement of oxidation resistance, and
3. Stability of hardness with high-time exposure at temperatures of 850–1000° C.

The new alloys were prepared by two methods:

1. Alloys B1, B2, and B4–B13 were prepared by melting a 1-lb heat via the well known nonconsumable arc-melting process. The melts were then drop cast into a ½"×1"×5". copper mold.
2. Alloys B3 and B13 were prepared in heats of 15 lb size which were melted by the well known air-induction-melting process. The melts were then cast into 2⅞-in.-diam graphite mold. The target and check analysis of the B1 alloys prepared by the two processes and the B3 by the AIM process are shown in Table 2.

A consideration in the preparation chemistry of the B alloys is the dissolution of molybdenum. For example, in a first preparation attempt, the B3 alloy missed the target molybdenum content because at the end of pouring the melt, some of the molybdenum was found to be undissolved. However, the same heat (alloy B1, Table 2) when melted a second time with sufficient time to dissolve molybdenum, made the target composition correctly. It should also be noted that an alloy of the present invention which is properly air-induction melted is essentially the same as that of the same alloy melted under controlled conditions of nonconsumable-arc process.

Data in Table 2 also shows that even when melted in air, the alloys of the present invention do not pick up significant amounts of impurities such as oxygen and nitrogen. Based on these observations, the melting and casting of the B alloys in air are recommended.

Samples from alloys of the present invention were exposed in air at 850, 900, 950, and 1000° C. The exposed samples were removed at various time intervals and their hardness and weight change were measured. Hardness data of unexposed and exposed samples are summarized in Tables 3 through 6. The weight change of the exposed samples from oxidation are summarized in Tables 7 through 10.

Figure 1:
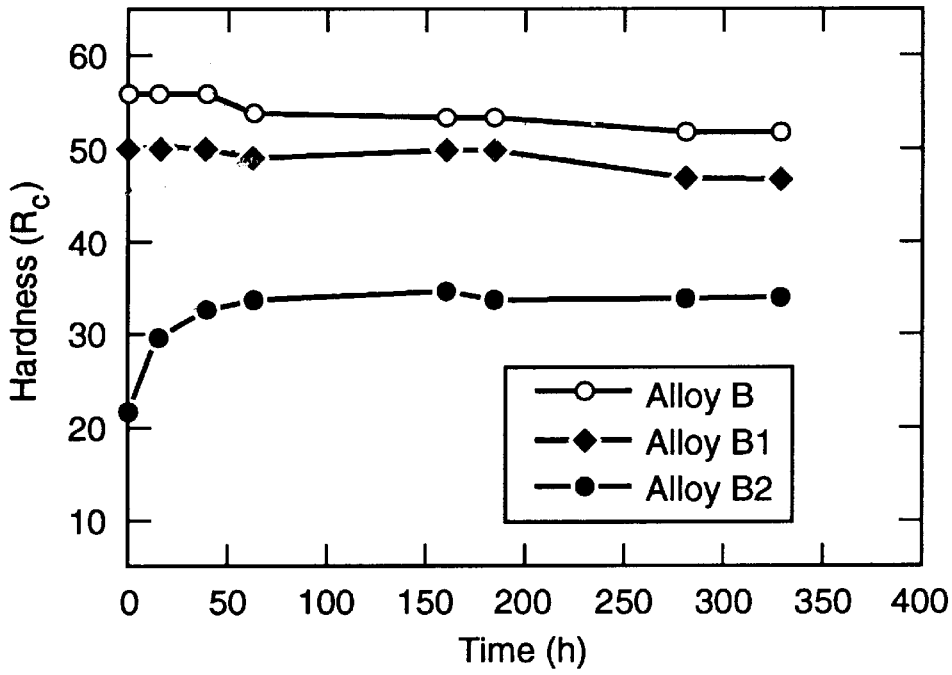
FIG. 1 is a graph showing room-temperature hardness as a function of time after heat treating at 850° C. for alloys B, B1, and B2.
Figure 2:
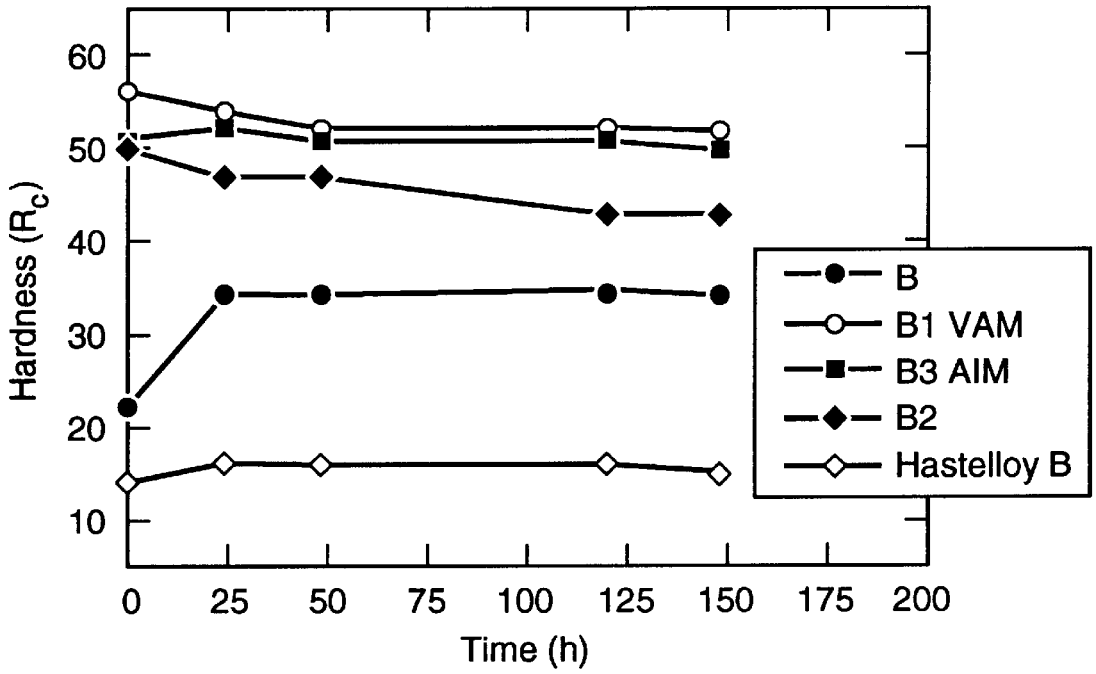
FIG. 2 is a graph showing room-temperature hardness as a function of time after heat treating at 900° C. for alloys B, B1, B2, and B3. Data for commercially processed wrought Hastelloy B is also included.
Figure 3:
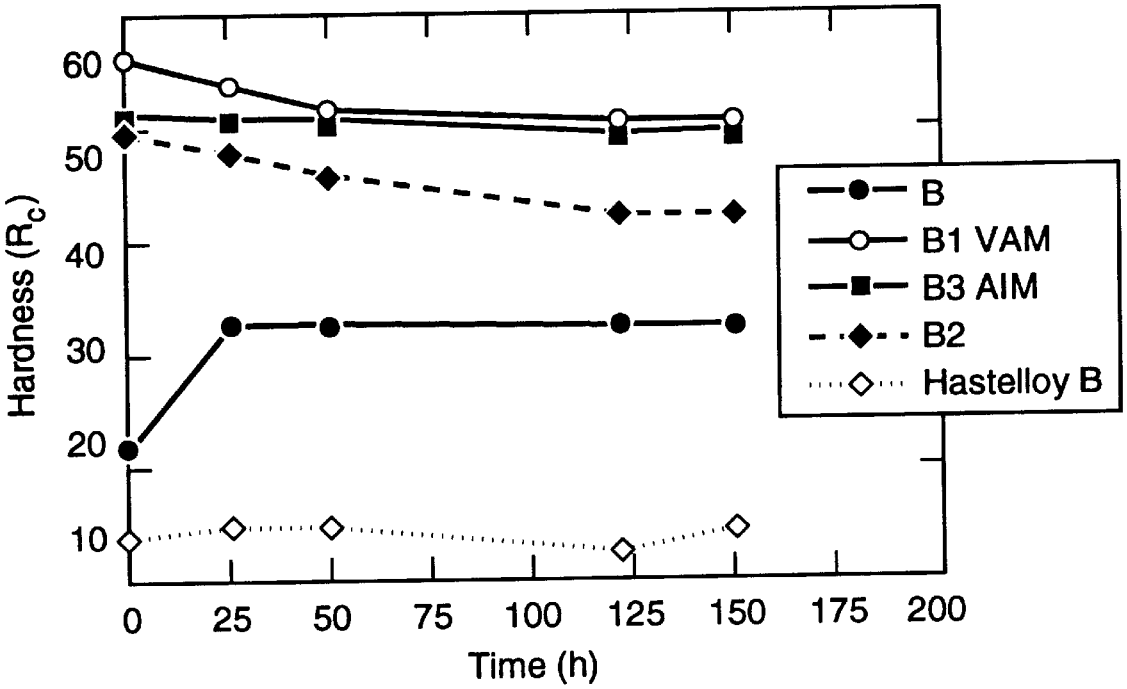
FIG. 3 is a graph showing room-temperature hardness as a function of time after heat treating at 950° C. for alloys B, B1, B2, and B3. Data for commercially processed wrought Hastelloy B is also included.
Figure 4:
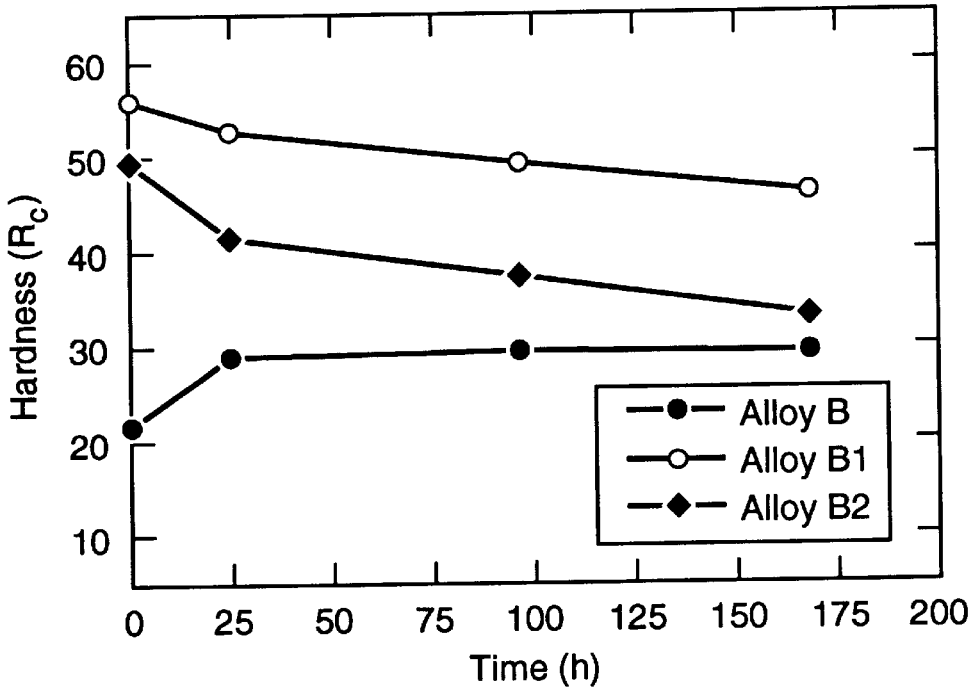
FIG. 4 is a graph showing room-temperature hardness as a function of time after heat treating at 1000° C. for alloys B, B1, and B2.
Figure 5:
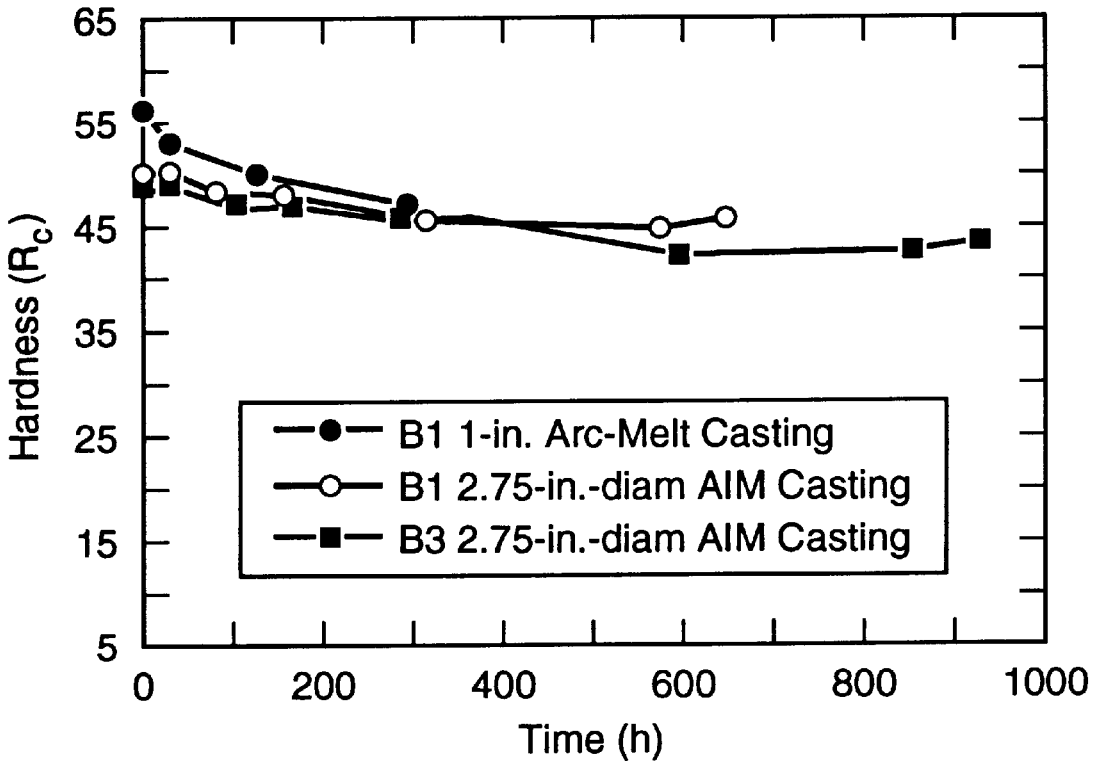
FIG. 5 is a graph showing room-temperature hardness as a function of time after heat treating at 1000° C. for arc- and air-induction-melted B1 and air-induction-melted B3.
Figure 6:
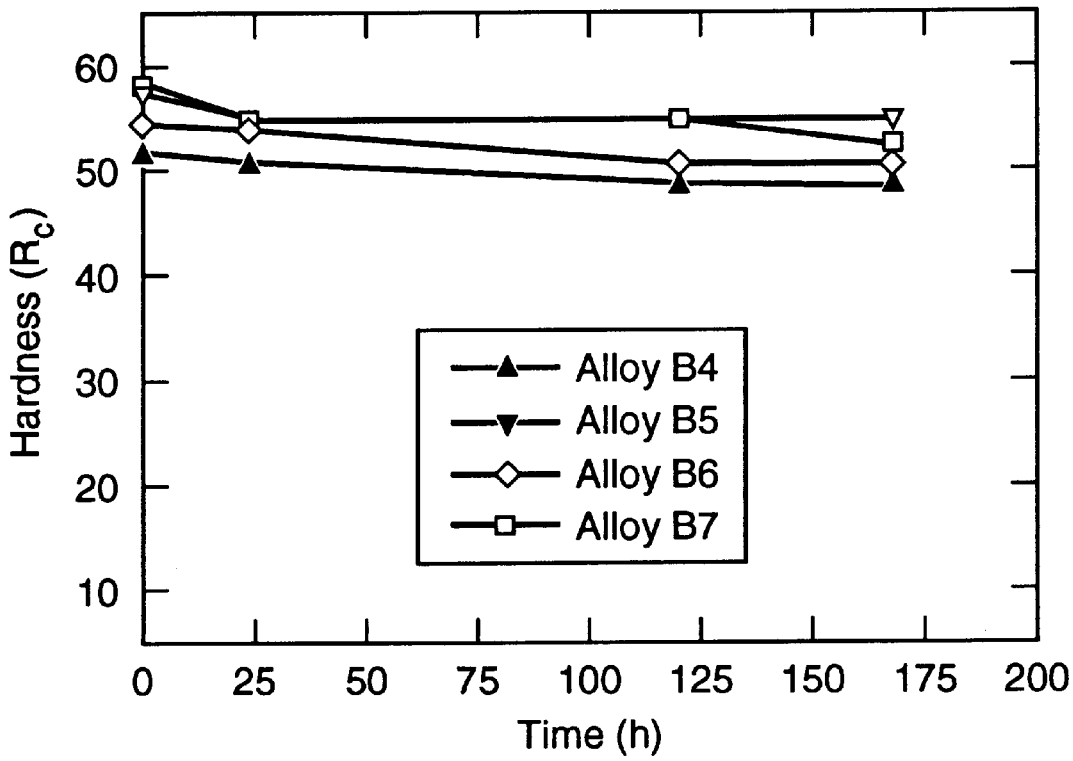
FIG. 6 is a graph showing room-temperature hardness as a function of time after heat treating at 850° C. for alloys B4, B5, B6, and B7.
Figure 7:
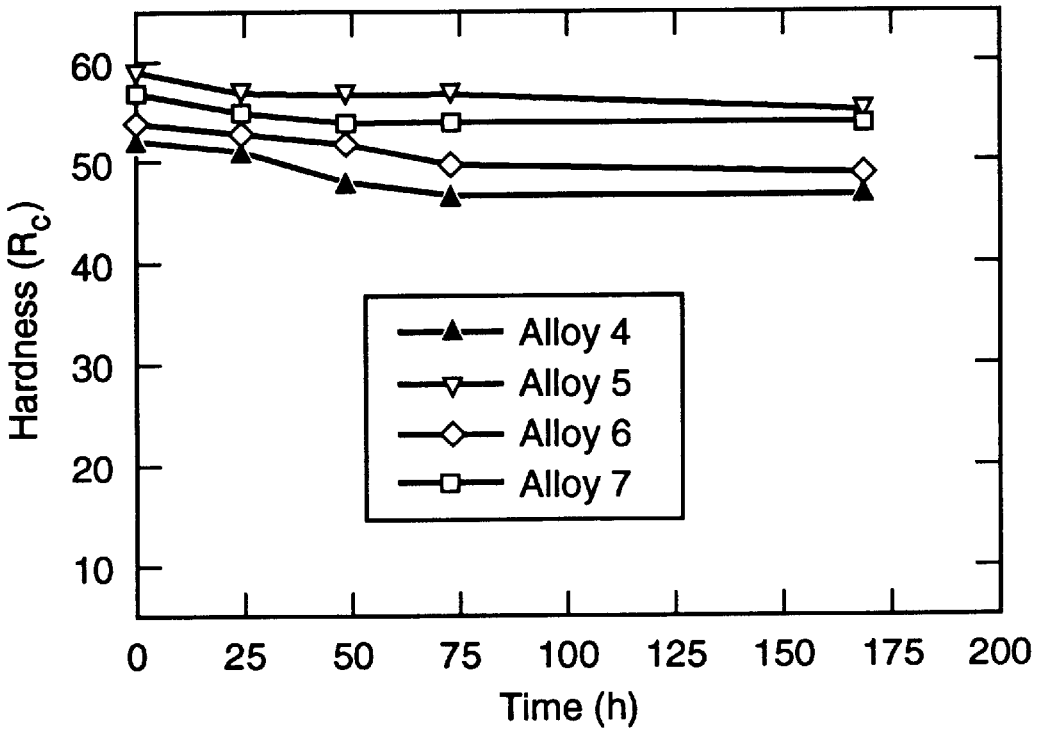
FIG. 7 is a graph showing room-temperature hardness as a function of time after heat treating at 900° C. for alloys B4, B5, B6, and B7.
Figure 8:
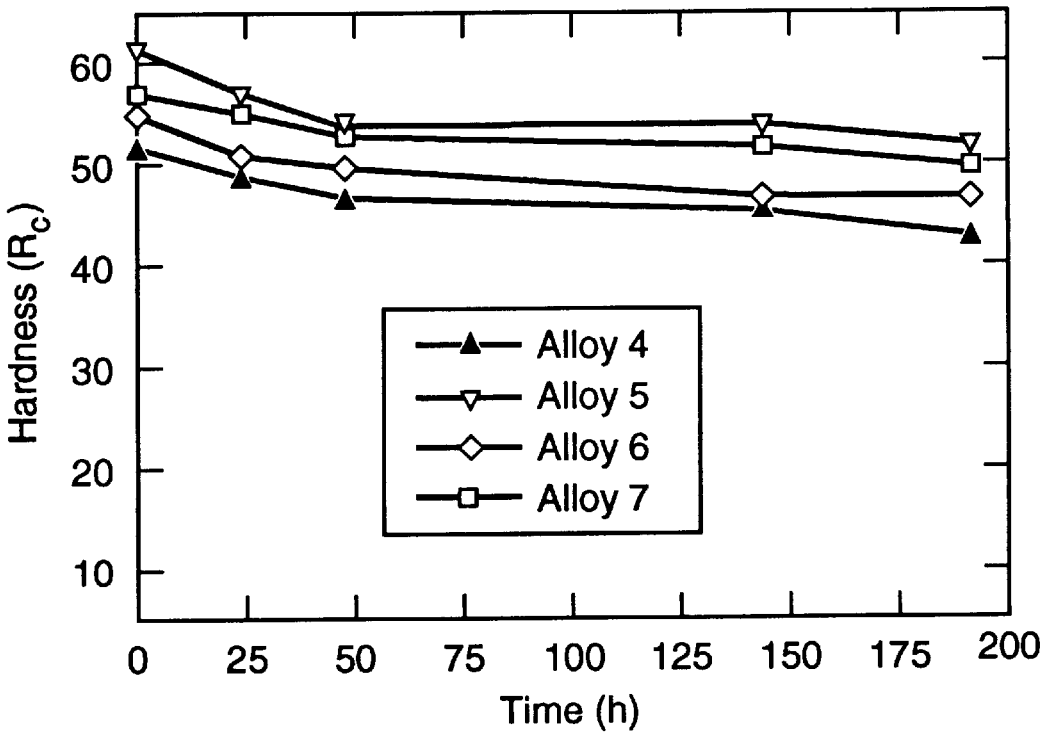
FIG. 8 is a graph showing room-temperature hardness as a function of time after heat treating at 950° C. for alloys B4, B5, B6, and B7.
Figure 9:
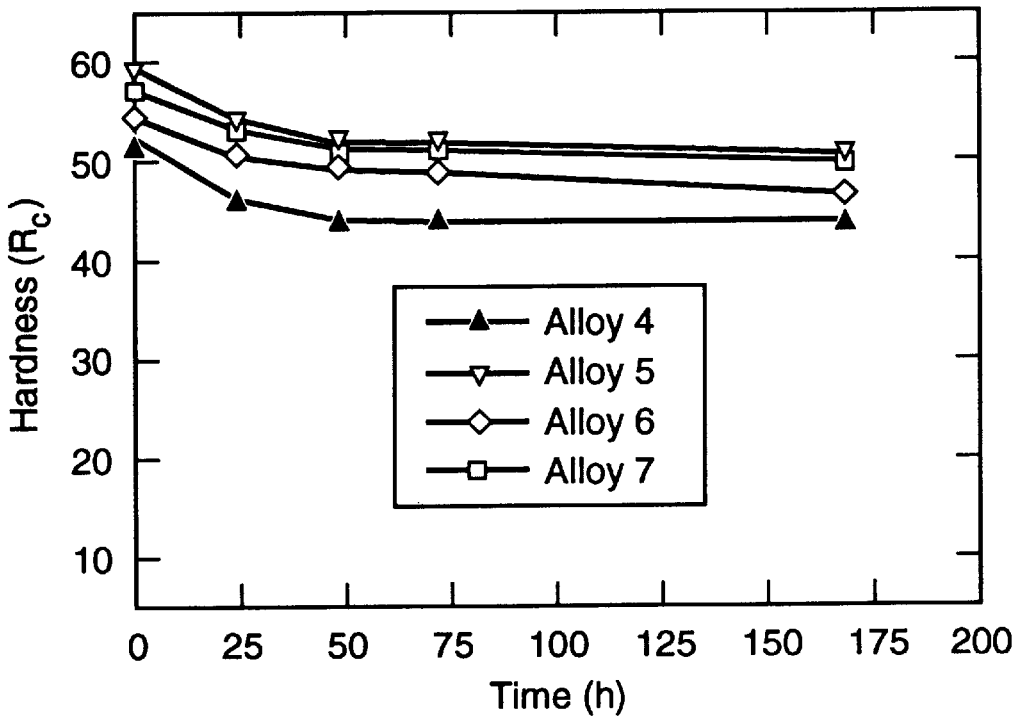
FIG. 9 is a graph showing room-temperature hardness as a function of time after heat treating at 1000° C. for alloys B4, B5, B6, and B7.
Figure 10:
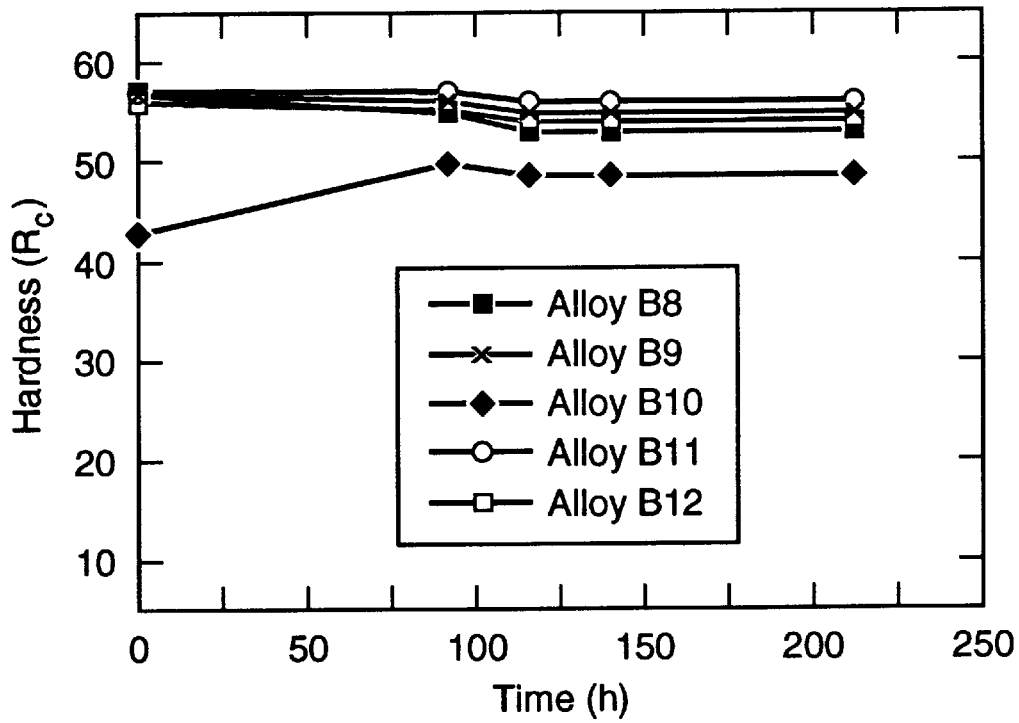
FIG. 10 is a graph showing room-temperature hardness as a function of time after heat treating at 850° C. for alloys B8, B9, B10, B11, and B12.
Figure 11A:
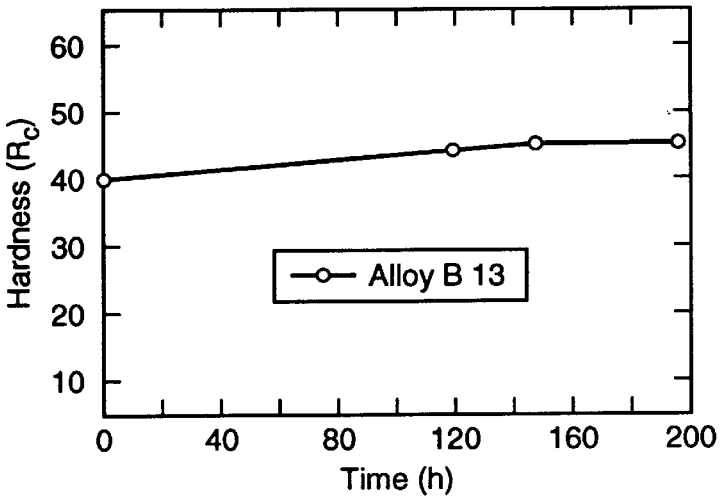
FIG. 11(*a*) is a graph showing room-temperature hardness as a function of time after heat treating at 850° C. for alloy B13.
FIG. 11(C) is a graph showing room-temperature hardness as a function of time after heat treating at 1000° C. for alloy B13.
Figure 11B:
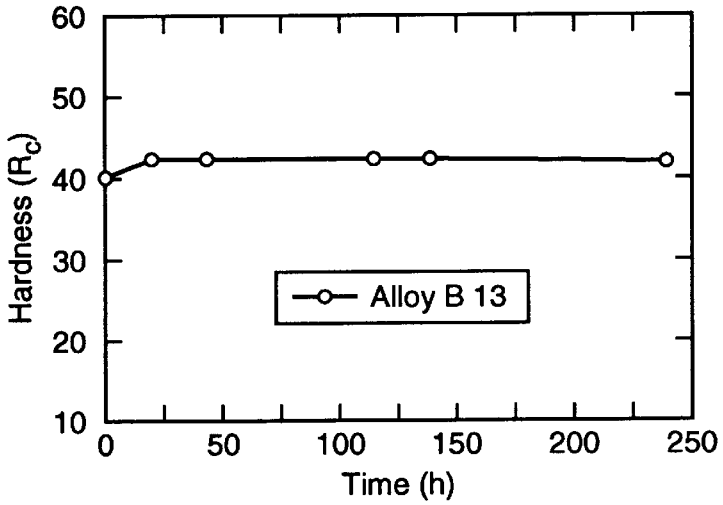
Figure 11C:
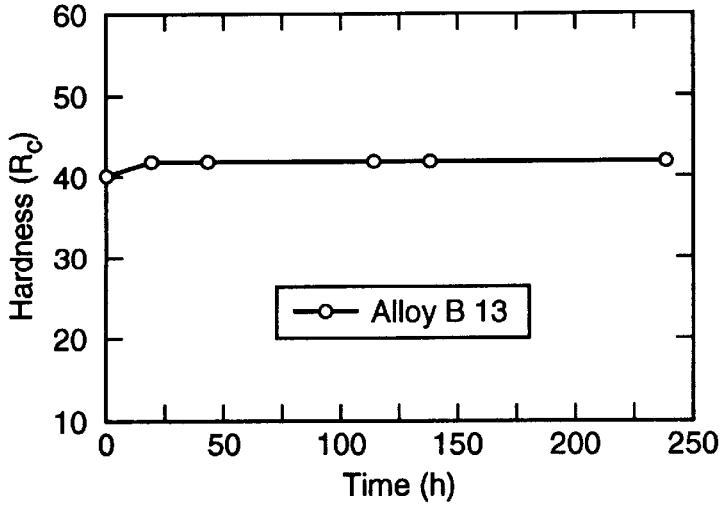
Figure 12:
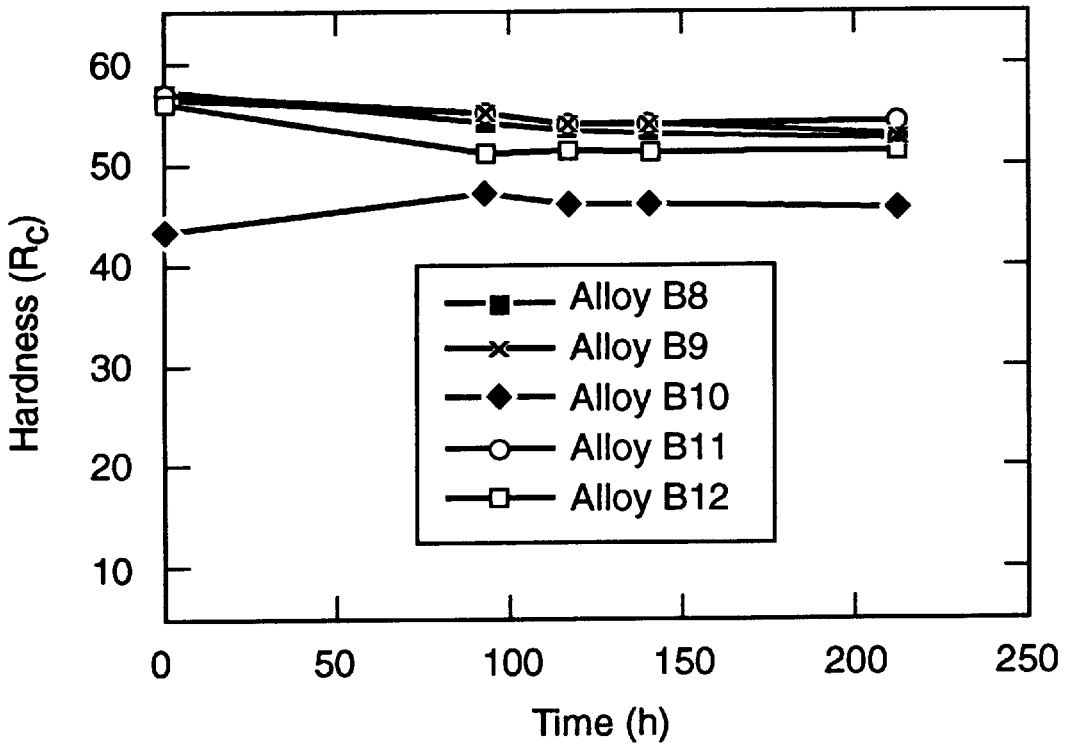
FIG. 12 is a graph showing room-temperature hardness as a function of time after heat treating at 900° C. for alloys B8, B9, B10, B11, and B12.
Figure 13:
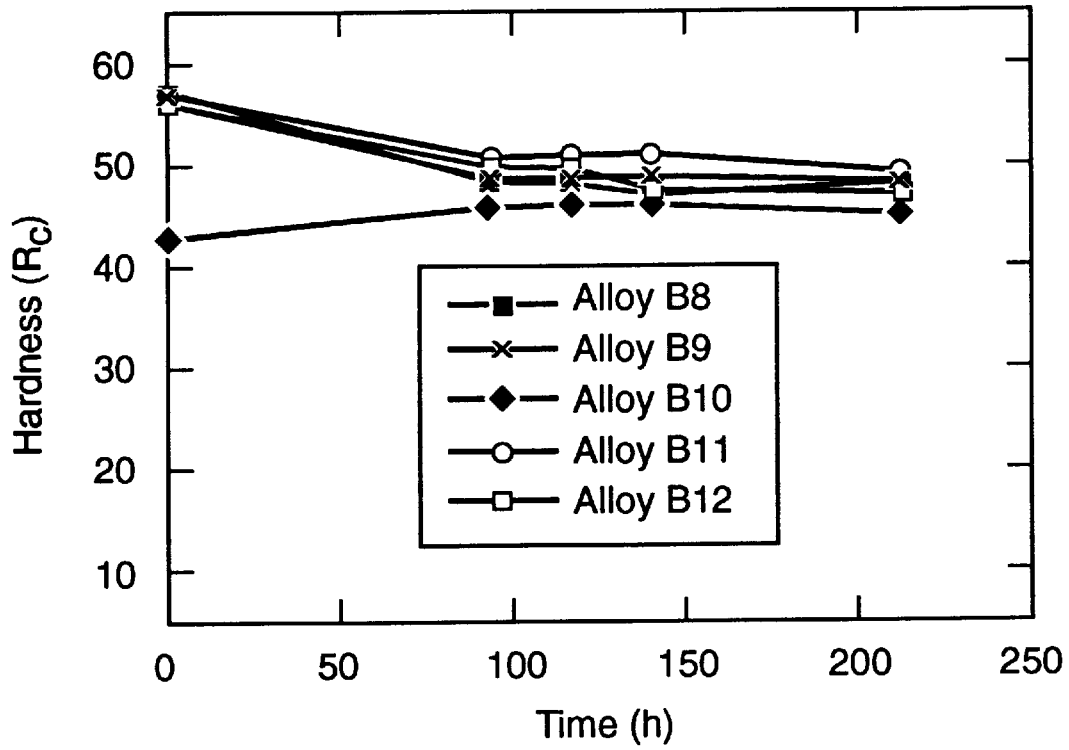
FIG. 13 is a graph showing room-temperature hardness as a function of time after heat treating at 1000° C. for alloys B8, B9, B10, B1, and B12.

Hardness data of alloys B, B1, and B2 after exposure at 850, 900, 950, and 1000° C. are plotted as a function of time in FIGS. 1 through 4. Hardness data change after exposure at 1000° C. for alloys B1 and B3 in arc and air-induction-melted conditions, respectively, are compared in FIG. 5. Hardness data for alloys B4, B5, B6, and B7 are plotted in FIGS. 6 through 9. Similar data for alloys B8, B9, B10, B 11, and B 12 are plotted in FIGS. 10 through 14.

Figure 14A:
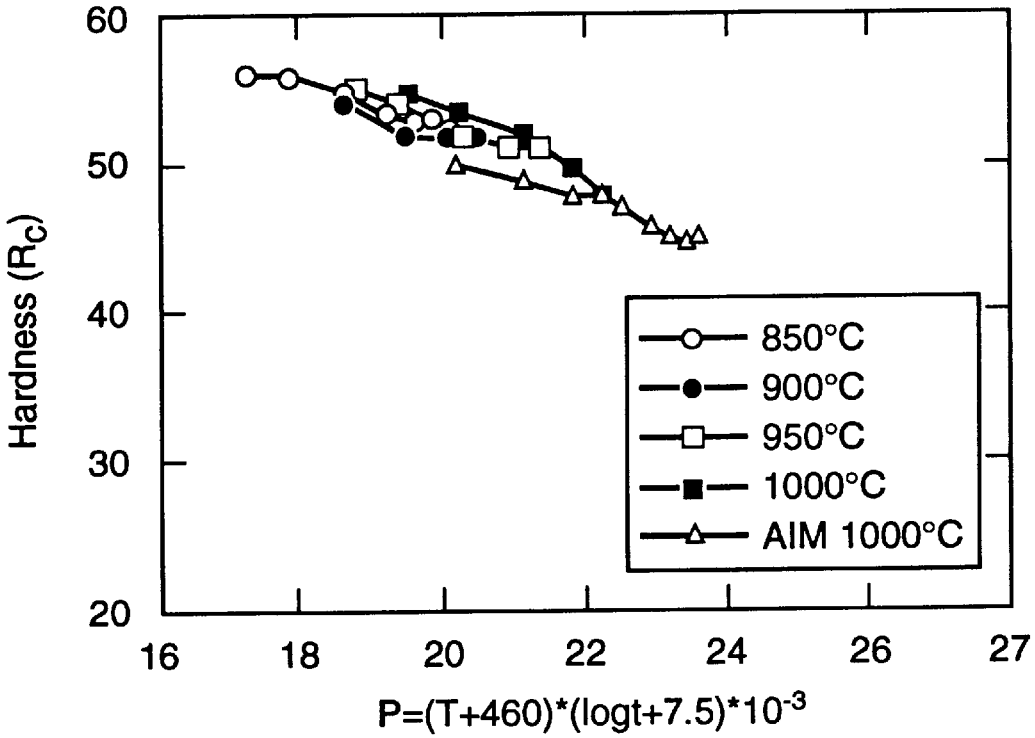
FIG. 14(*a*) is a graph showing room-temperature hardness as a function of Larsen-Miller (LM) parameter. The LM parameter was used to combine the change in hardness due to exposure at various temperatures for alloy B1.
Figure 14B:
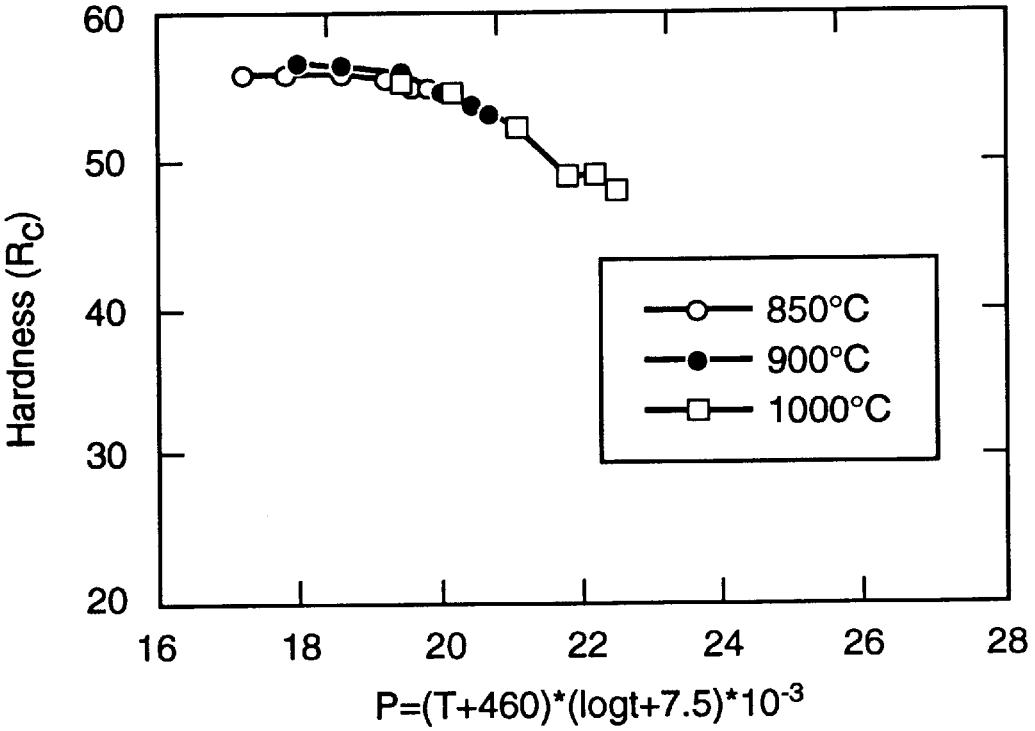

Effects of exposure at 850, 900, 950, and 1000° C. on hardness of alloys of the present invention can be combined by using the Larsen-Miller parameter:

$$LM=(T+460)\ (\log t+7.5)$$

where T is exposure temperature in ° F., and t is the exposure time in hour. Hardness/Larsen Miller parameters of the B1 and B9 alloys are shown in FIGS. 14(*a*) and 14(*b*) respectively. Note that the hardness changes for the air induction-melted and arc-melted alloys are similar.

Hardness data plots in FIGS. 1 through 14 show that the alloys B1–B13 show high hardness in the as-cast condition, which changes very little even after long-term exposures at temperatures of 850, 900, and 950° C. The greatest change in hardness of the modified B alloys only occurs after exposure at 1000° C. However, alloy B9 maintained a hardness of Rockwell C48 even after a 200 h exposure at 1000° C. Moreover, FIGS. 11(*a*), 11(*b*), and 11(*c*) show that the hardness of alloy B13 actually increased after exposures at 850, 900, and 1000° C., respectively.

The data presented herein shows some interesting comparisons of the alloys B1–B13 with the standard alloy B. Hardness of the alloys B1–B13 is high in as-cast condition and decreases slightly with thermal exposure. In contrast the hardness of alloy B is much lower in as-cast condition and increases with thermal exposure. Even though the hardness of alloy B increases, it still remains at levels of Rockwell C 30 to 34, which is not adequate for die applications.

As compared to the cast alloy B, the hardness of commercially procured wrought Hastelloy B was found to be very low, as shown in the data presented herein.

Figure 15:
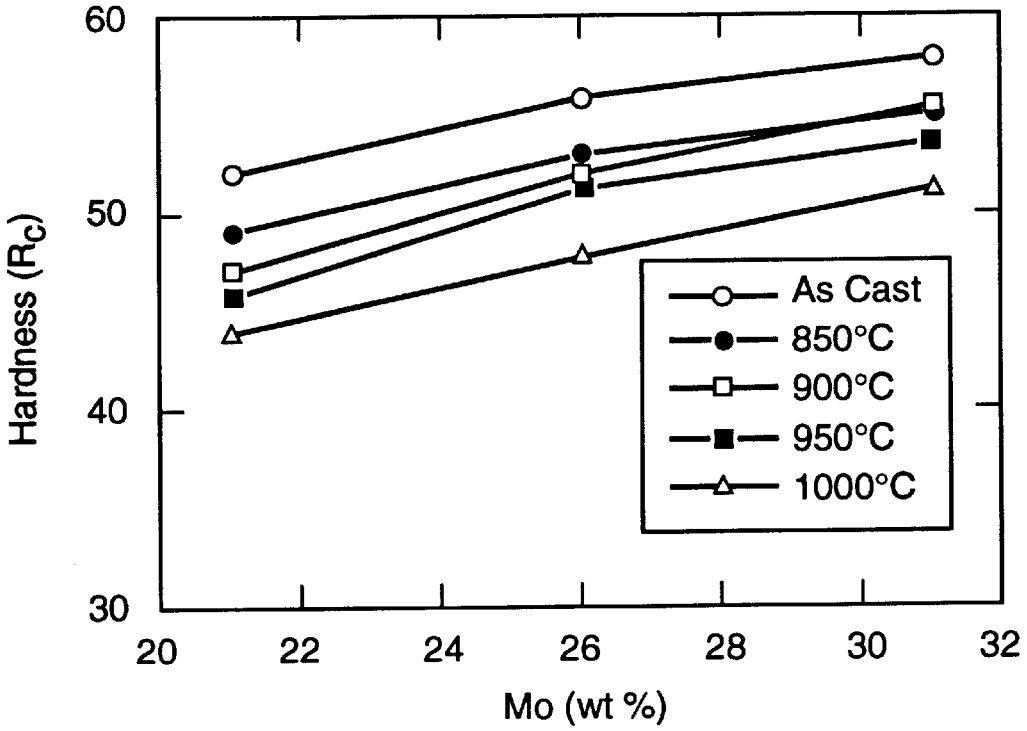
FIG. 15 is a graph showing effect of molybdenum-content variation on room-temperature hardness in the as-cast condition and after 150-h exposure at four temperatures for aluminum-modified B alloys.

The effect of molybdenum-content variation on room-temperature hardness in the as-cast condition and after 150-h exposure at 850, 900, 950, and 1000° C. for alloys of the present invention is shown in FIG. 15. For the study on effect of molybdenum variation, Al and Fe were kept constant at 4.5 and 8.0 wt %, respectively. Data in FIG. 15 show that the hardness increases with increases in the molybdenum content. In all cases, hardness decreases by the same amount upon 150-h exposure at the four temperatures of 850, 900, 950, and 1000° C.

Figure 16:
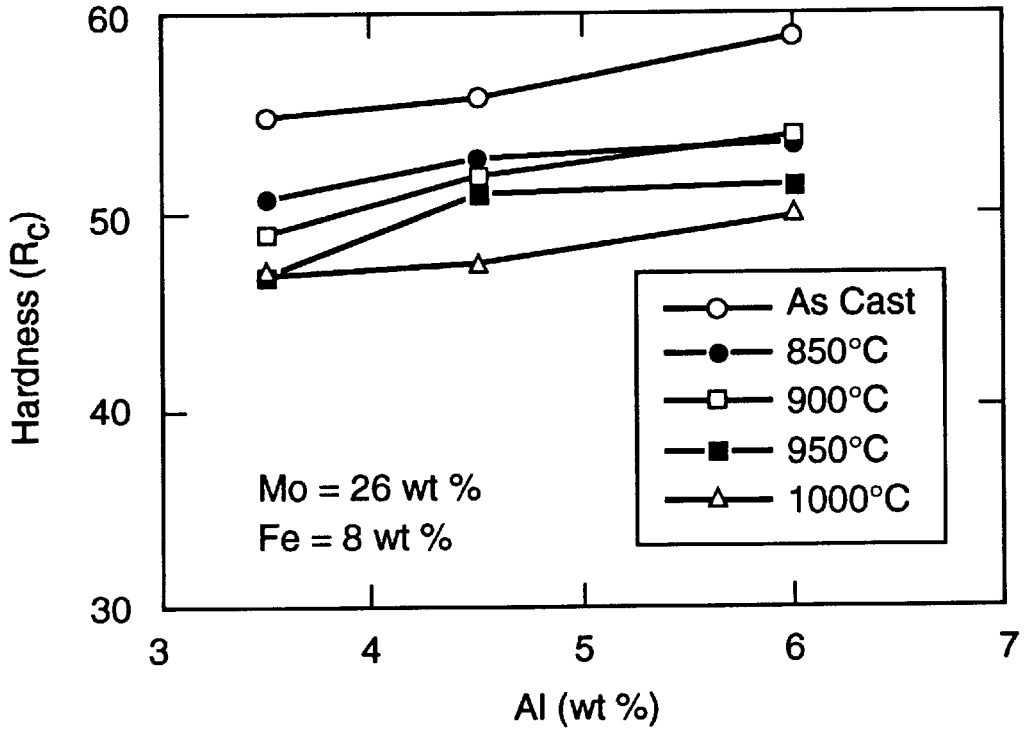
FIG. 16 is a graph showing effect of aluminum-content variation on room-temperature hardness in the as-cast condition and after 150-h exposure at four temperatures for aluminum-modified B alloys.
Figure 17:
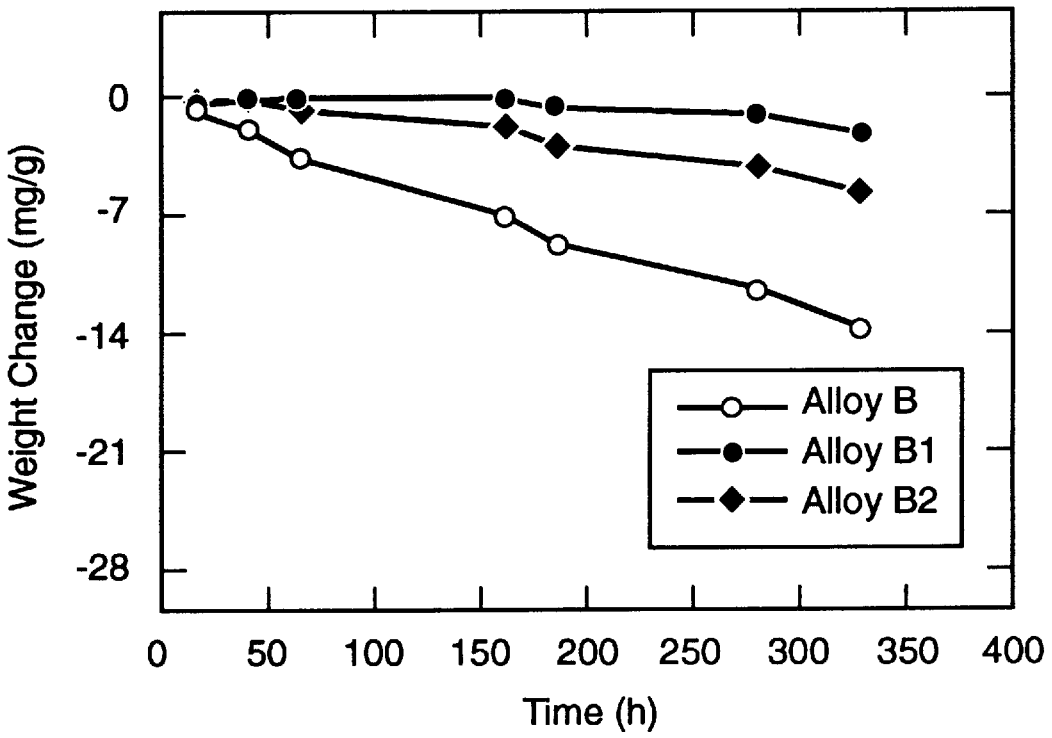
FIG. 17 is a graph showing weight change as a function of time for exposure in air at 850° C. for alloys B, B1, and B2.
Figure 18:
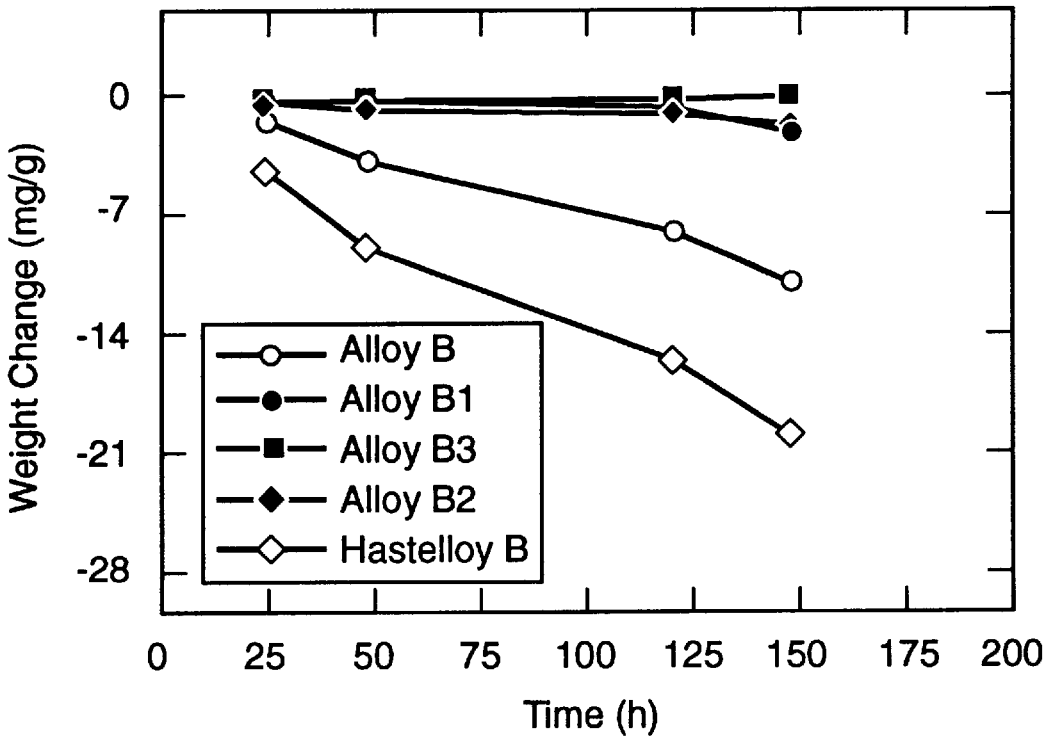
FIG. 18 is a graph showing weight change as a function of time for exposure in air at 900° C. for alloys B, 1, and B2. Data for commercially processed wrought Hastelloy B is also included.
Figure 19:
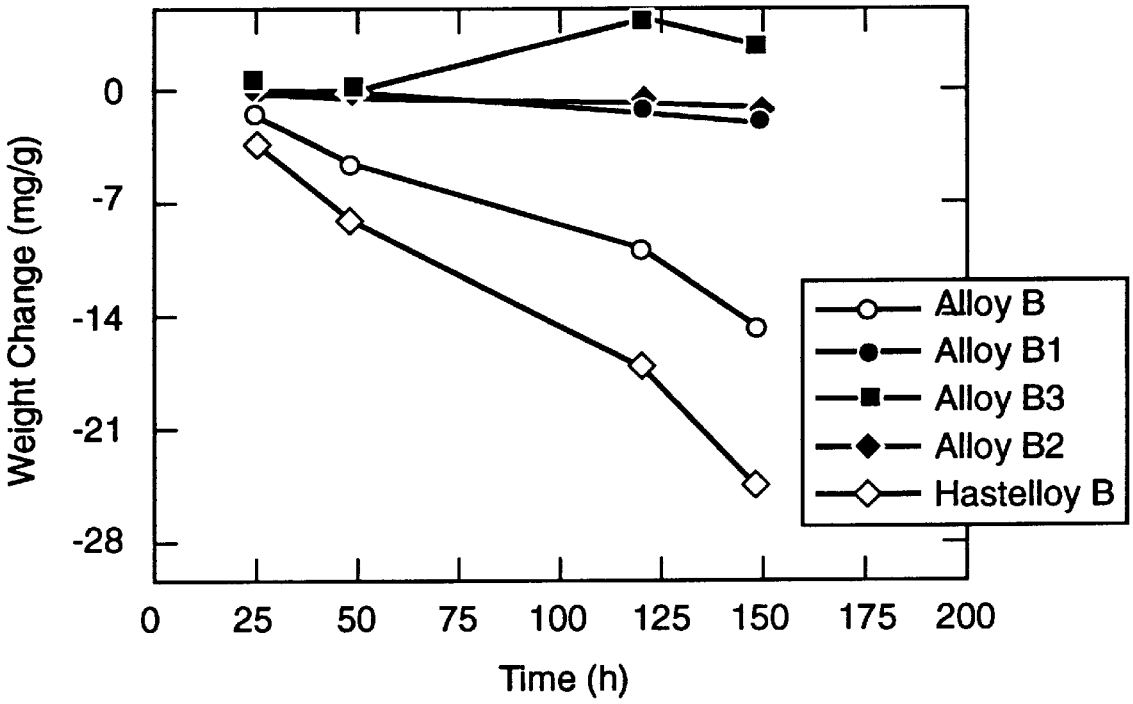
FIG. 19 is a graph showing weight change as a function of time for exposure in air at 950° C. for alloys B, 1, and B2. Data for commercially processed wrought Hastelloy B is also included.
Figure 20:
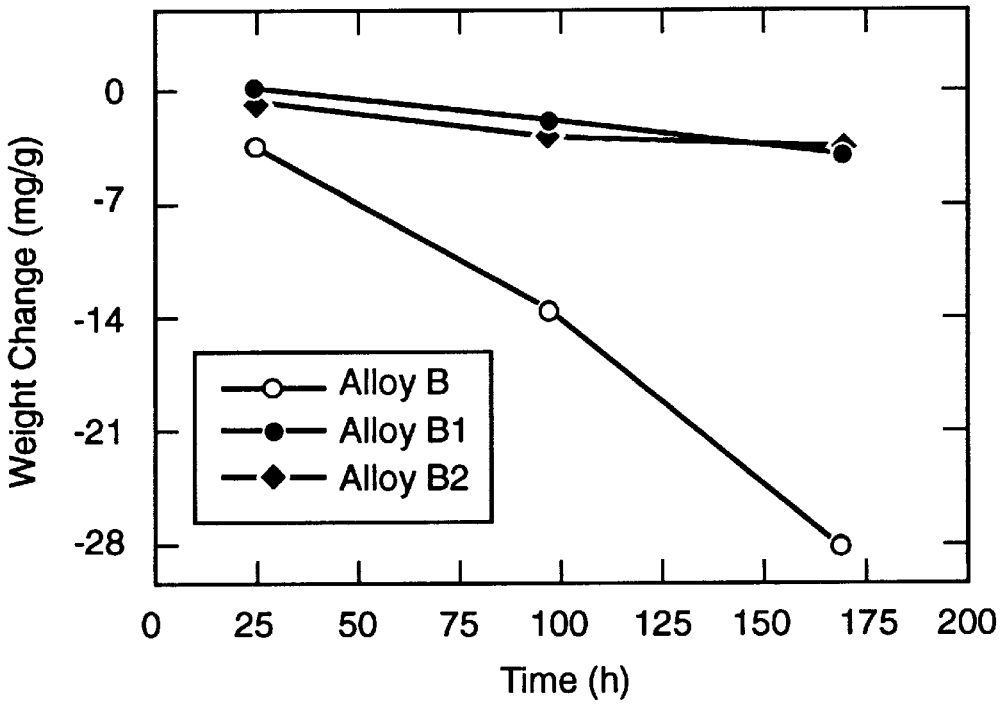
FIG. 20 is a graph showing weight change as a function of time for exposure in air at 100° C. for alloys B, B1, and B2.
Figure 21:
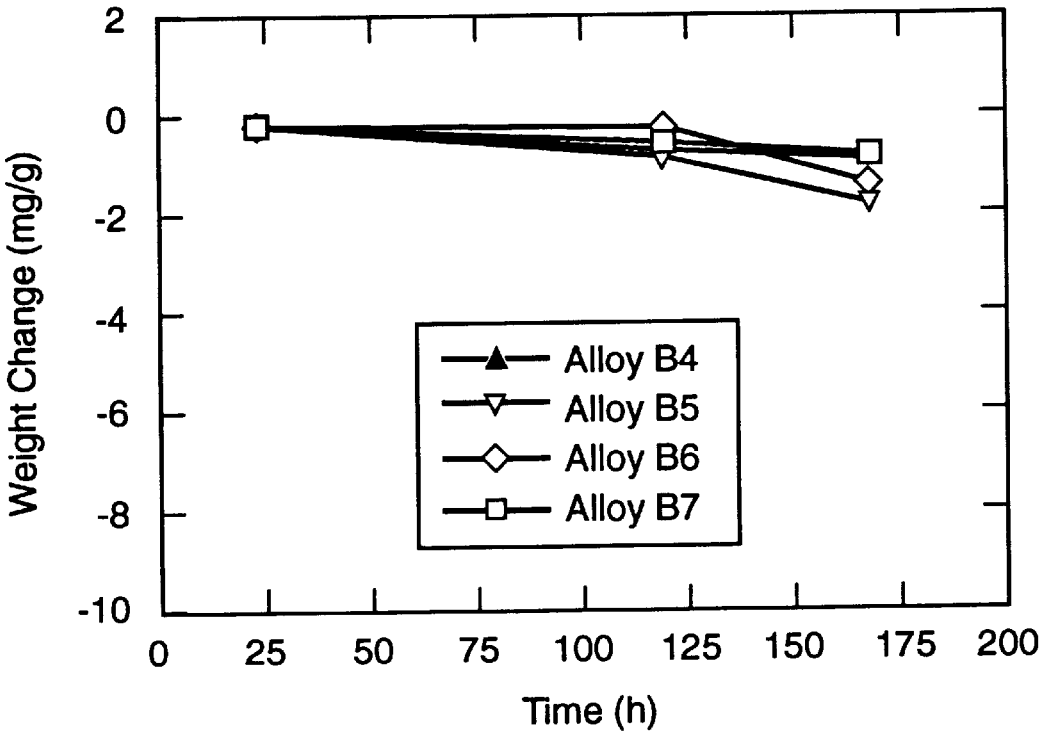
FIG. 21 is a graph showing weight change as a function of time for exposure in air at 850° C. for alloys B4, B5, B6, and B7.
Figure 22:
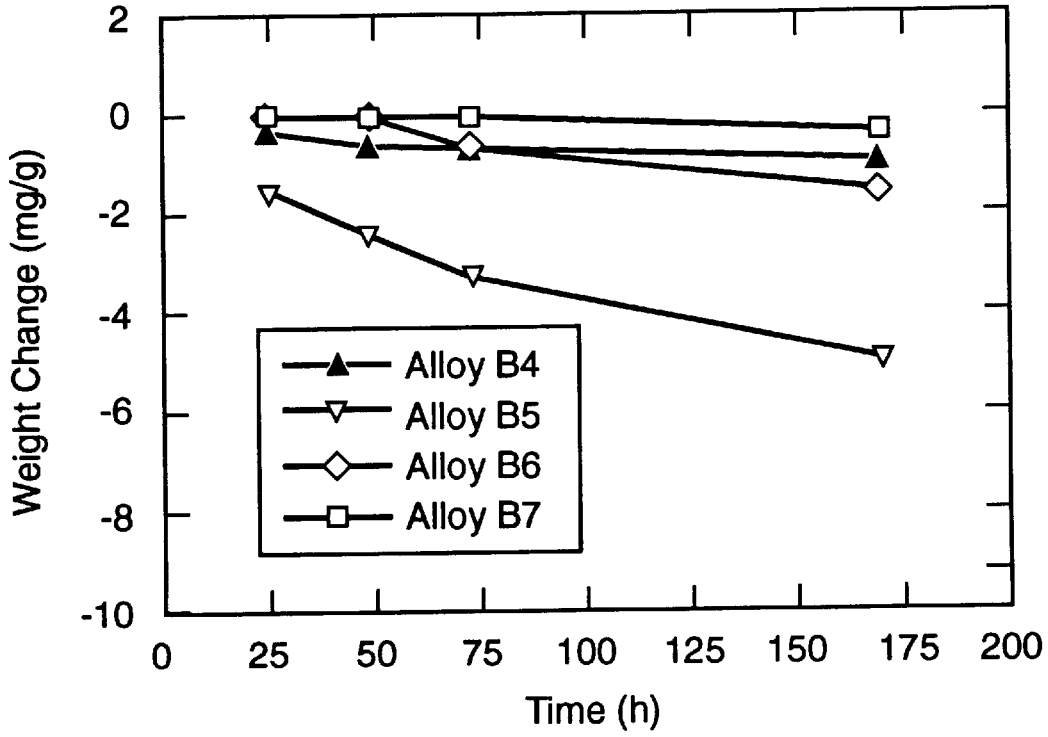
FIG. 22 is a graph showing weight change as a function of time for exposure in air at 900° C. for alloys B4, B5, B6, and B7.
Figure 23:
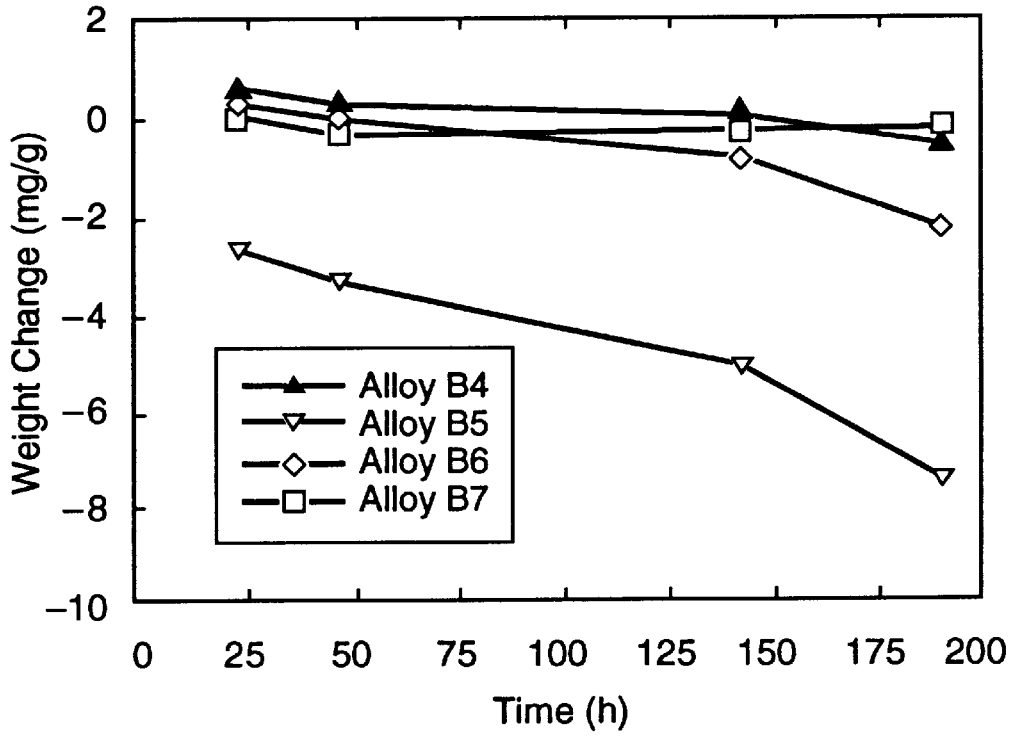
FIG. 23 is a graph showing weight change as a function of time for exposure in air at 950° C. for alloys B4, B5, B6, and B7.
Figure 24:
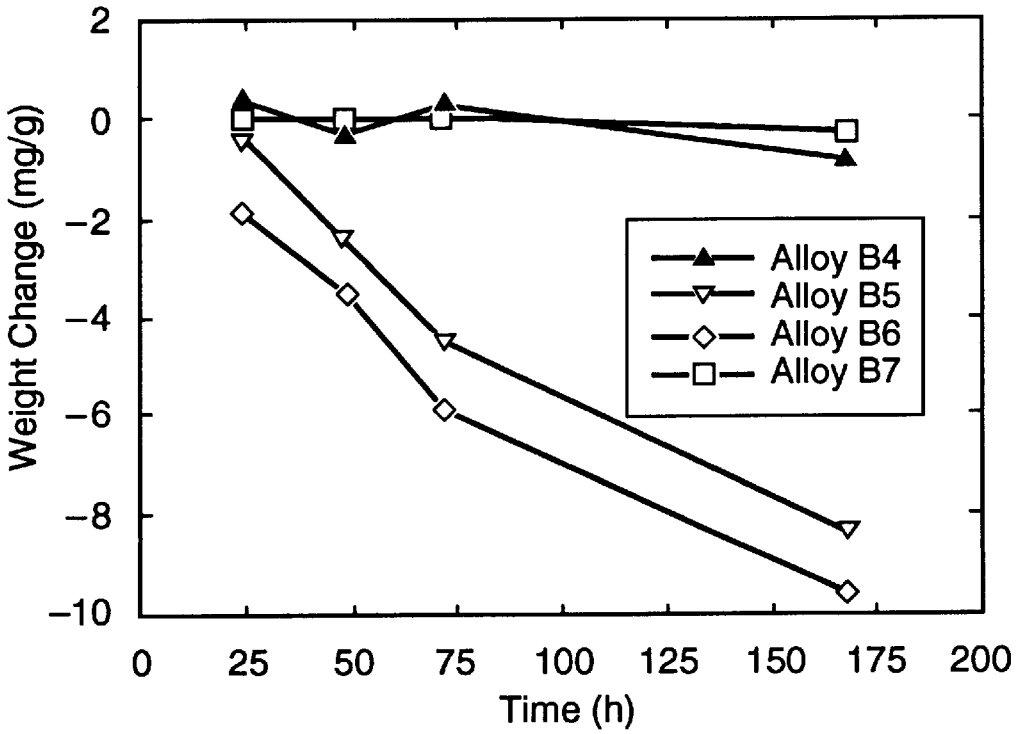
FIG. 24 is a graph showing weight change as a function of time for exposure in air at 1000° C. for alloys B4, B5, B6, and B7.
Figure 25:
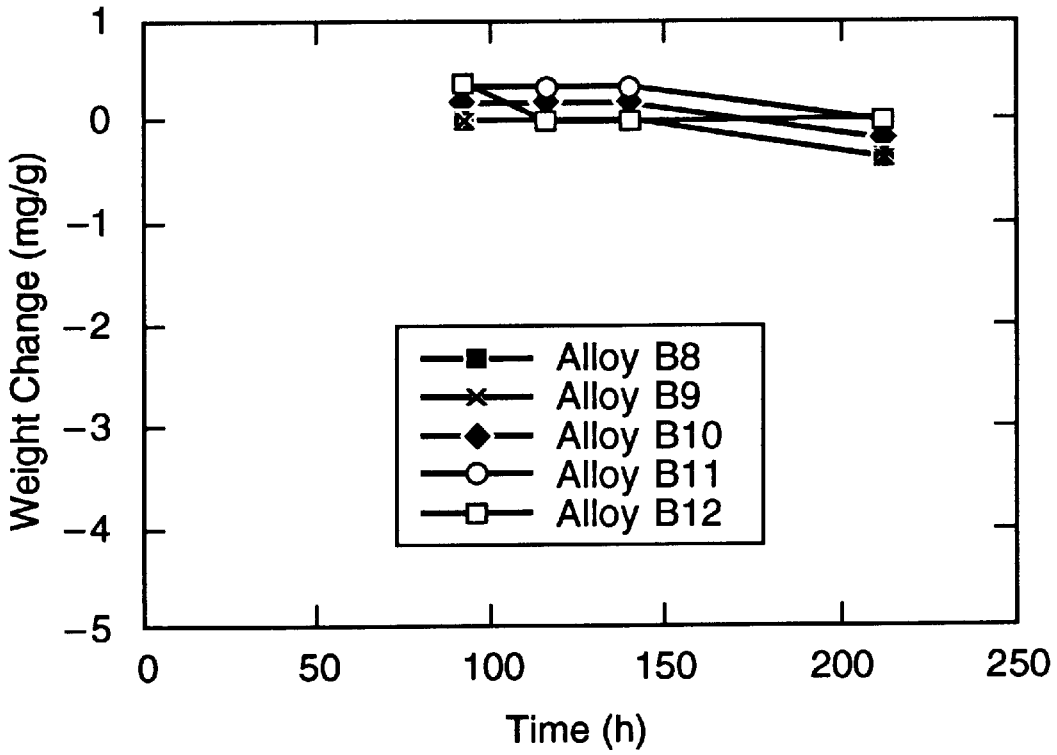
FIG. 25 is a graph showing weight change as a function of time for exposure in air at 850° C. for alloys B8, B9, B10, and B11.
Figure 26:
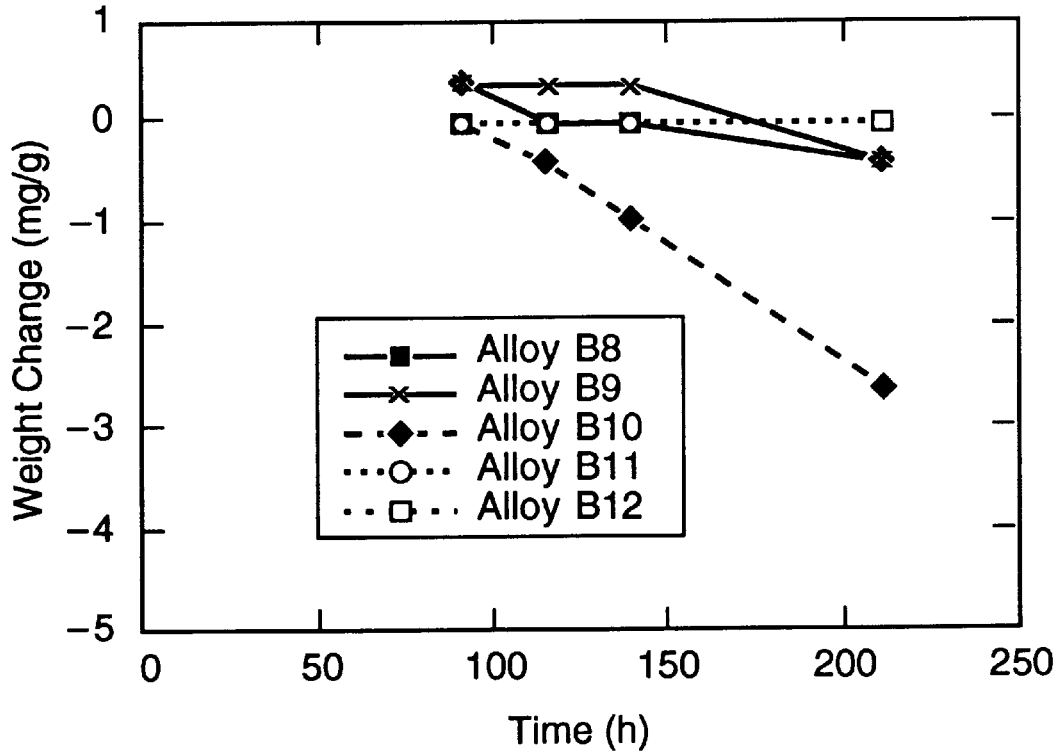
FIG. 26 is a graph showing weight change as a function of time for exposure in air at 900° C. for alloys B8, B9, B10, and B11.
Figure 27:
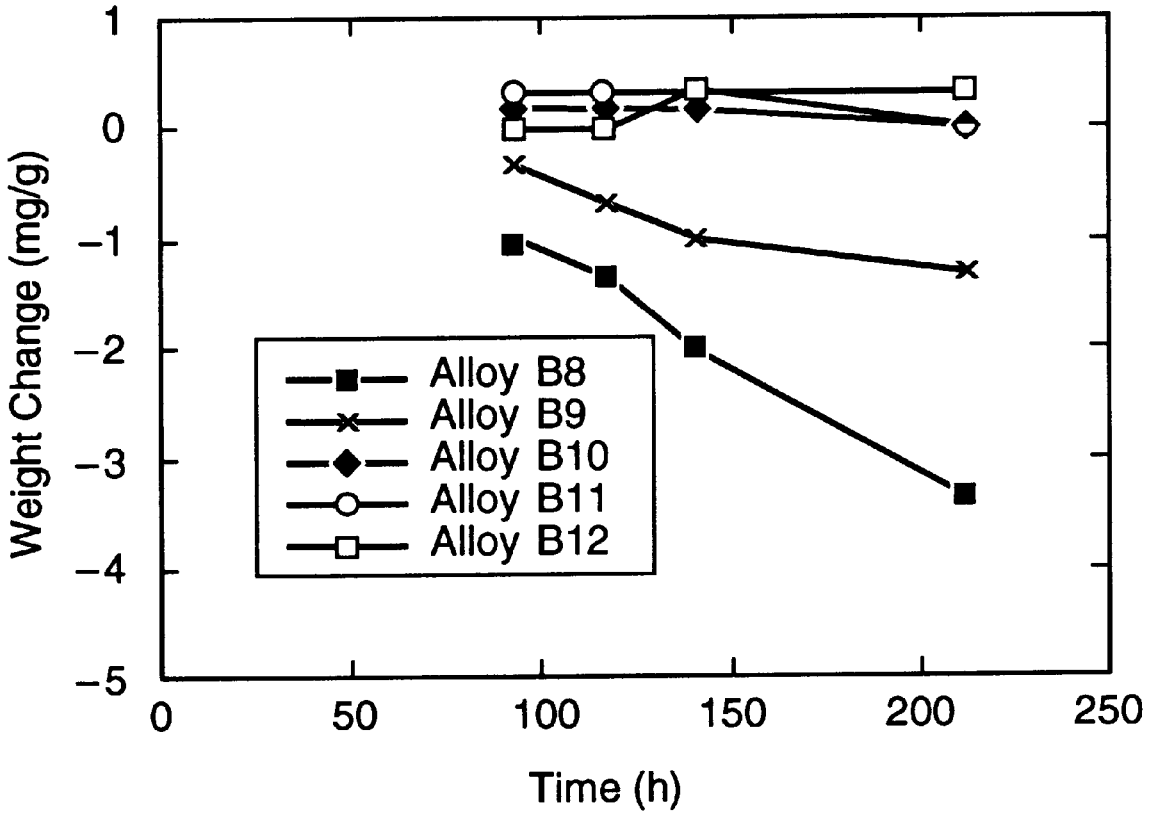
FIG. 27 is a graph showing weight change as a function of time for exposure in air at 1000° C. for alloys B8, B9, B10, and B11.
Figure 28:
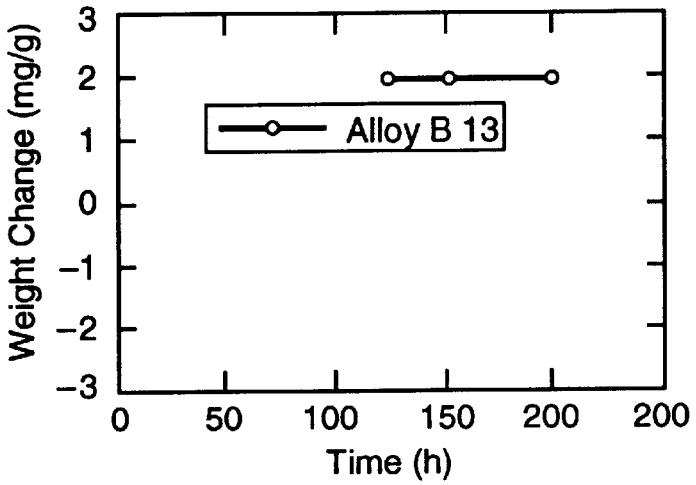
FIG. 28(*a*) is a graph showing weight change as a function of time for exposure in air at 850° C. for alloy B13.
Figure 28:
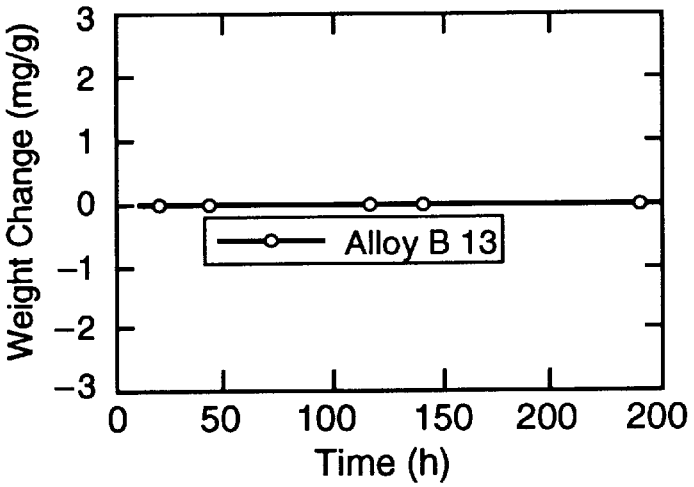
Figure 28:
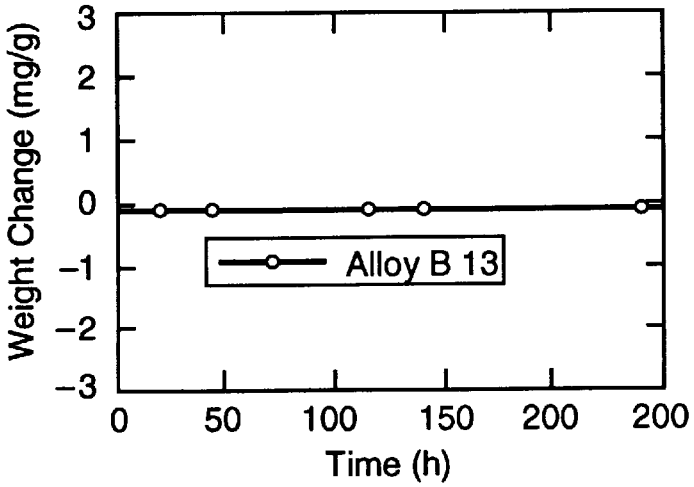

The effect of aluminum-content variation on room temperature hardness in the as-cast condition and after 150-h exposures at 850, 900, 950, and 1000° C. for alloys of the present invention is shown in FIG. 16. For the study on the effect of aluminum-content variation, Mo and Fe were kept constant at 26 and 8 wt %, respectively. Increased aluminum content also increased the hardness of the alloys. Moreover, the increased hardness attributable to the aluminum addition was retained after the 150-h exposure at the four test temperatures.

Weight changes of alloys of the present invention as a function of exposure time at 850, 900, 950, and 1000° C. were measured. The measured weight changes for various alloys are plotted as a function of exposure time in FIGS. 17 through 28. Data in these figures were used to tabulate the weight change after specified exposure times in Tables 7 through 10. Plots in FIGS. 17 through 28 show that the alloys of the present invention have significantly less weight change than the as-cast B alloy or commercially processed wrought Hastelloy B.

Figure 29:
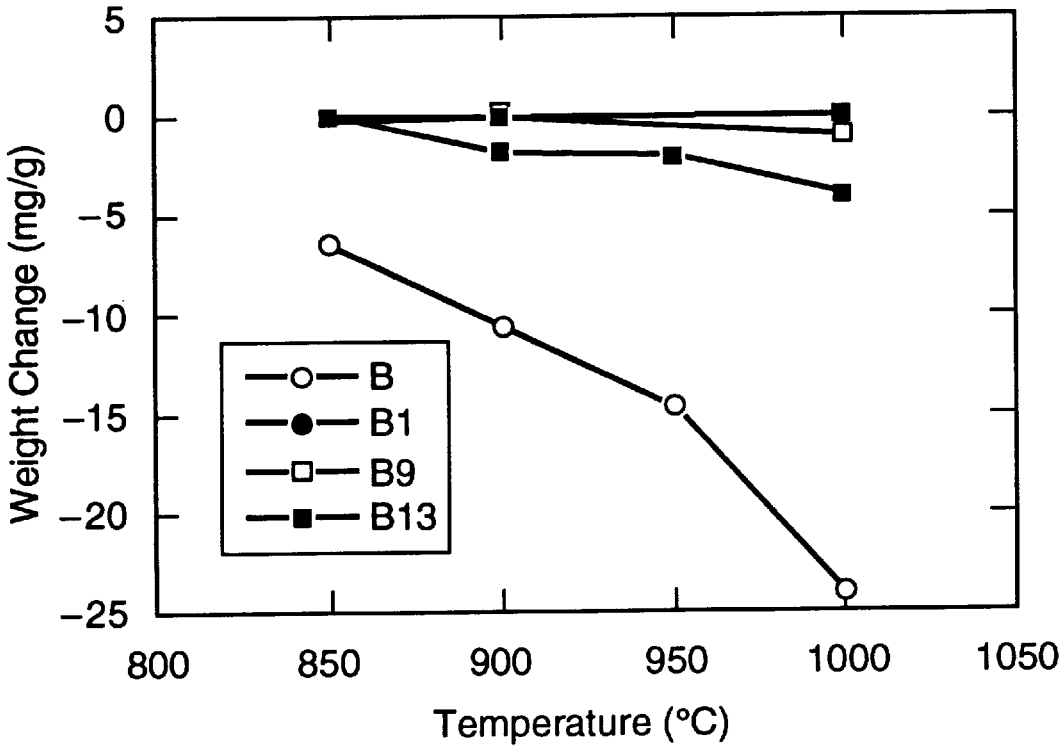
FIG. 29 is a graph showing weight change after 150-h exposure in air as a function of temperature for alloys B, B1, B9, and B13.

A comparison of weight changes after 150-h exposure in air for selected alloys (B, B 1, and B9) are plotted in FIG. 29. Data in this figure show that the aluminum modifications improves the oxidation resistance of the B alloys, and the combined presence of Cr and Al produces an additional improvement.

Figure 30:
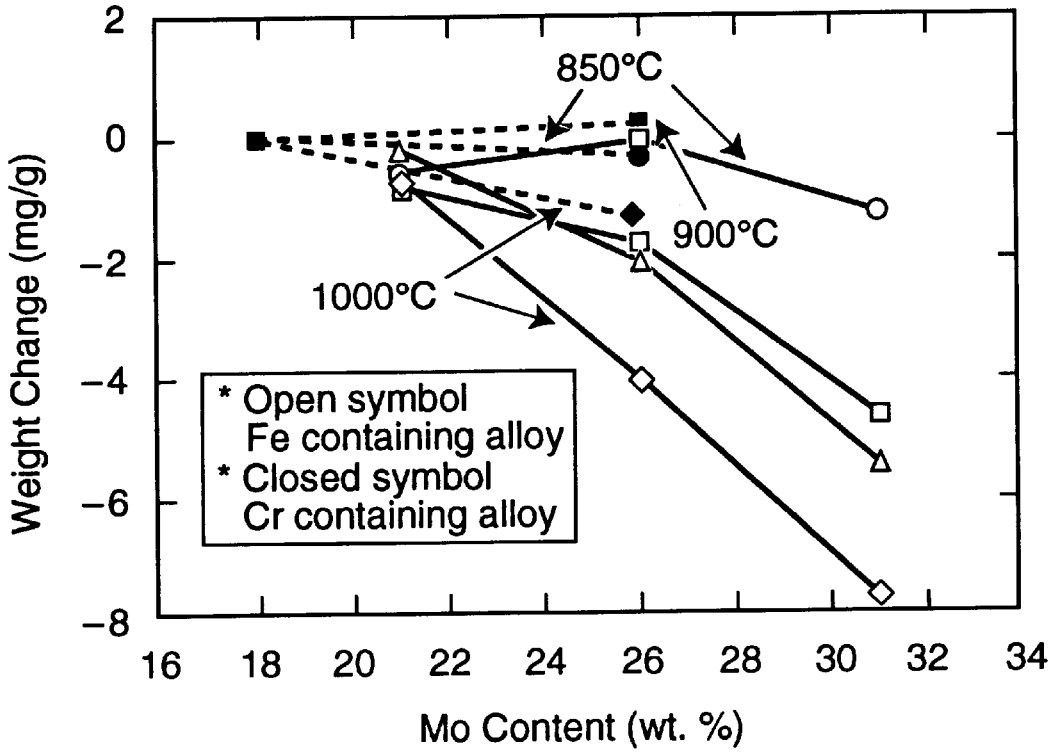
FIG. 30 is a graph showing effect of molybdenum-content variation on weight change after 150-h exposure at four temperatures for aluminum-modified B alloys.
Figure 31:
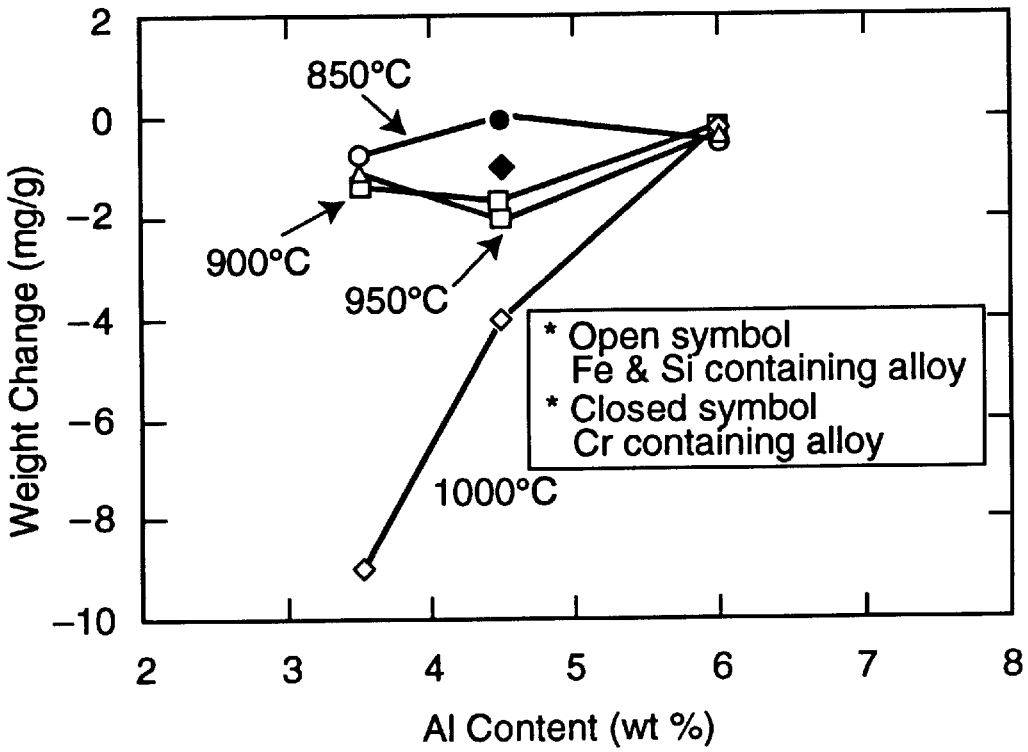
FIG. 31 is a graph showing effect of aluminum-content variation on weight change after 150-h exposure at four temperatures for aluminum-modified B alloys.
Figure 32:
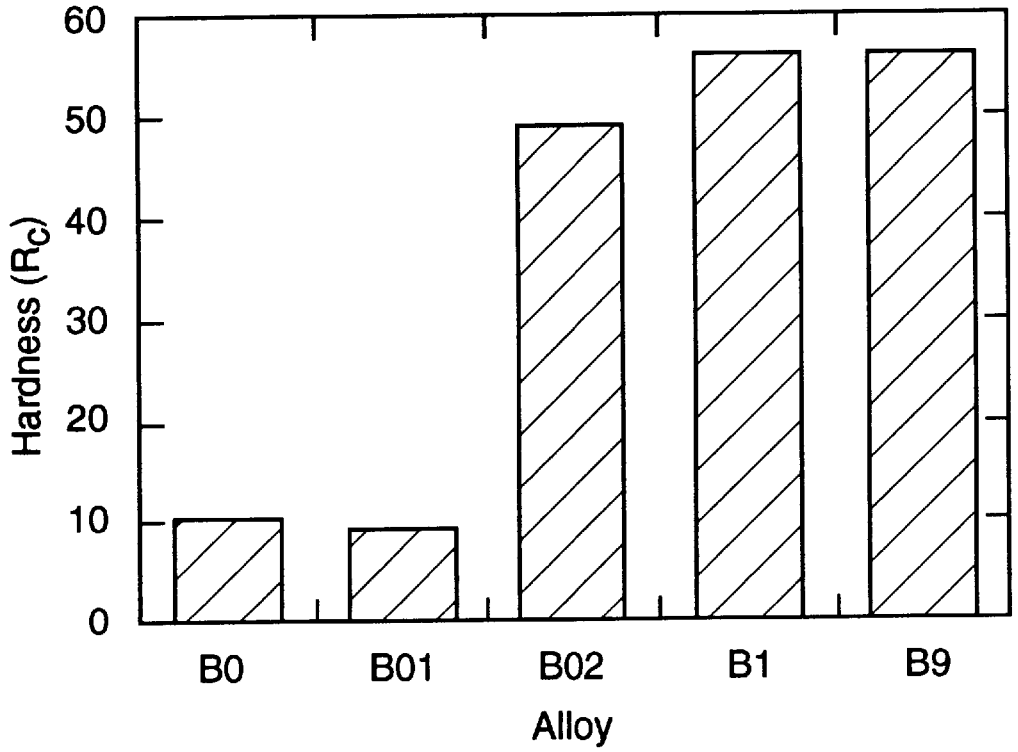
FIG. 32 is a graph showing hardness data of B alloys with systematic addition of alloying elements (data from Table 11).

The effect of Mo and Al variation on the resistance of oxidation of the modified B alloys is plotted in FIGS. 30 and 31. Data for alloys where iron has been replaced by chromium is also included in FIGS. 30 and 31. there data show that:

1. Increasing molybdenum content decreases the oxidation resistance,
2. Increasing the aluminum content increases the oxidation resistance, and
3. For the same molybdenum content, Cr- and Al-containing alloys show significantly better oxidation resistance than the Fe- and Al-containing alloys.

In order to determine the source of increased hardness of alloys of the present invention, three additional alloys designated as B0, B01, and B02 were prepared in 1-lb-size heats by the nonconsumable-arc-melting process. The alloy compositions and corresponding hardnesses are shown in Table 11 and plotted as a bar graph in FIG. 31. It is clear from these data that simple NiMo or NiMoCr alloys have very low hardness. However, when alloying element aluminum is added to the base NiMo composition, hardness increases very significantly. The NiMoAl composition hardness increased further by additions of Fe, Si, B, and C in alloy B1 and in B9 by additions of Cr, B, and C. Since Cr and Fe are similar elements, it can be inferred that iron has no effect on increasing the hardness of the NiMo alloys. Further examination of alloys B1 and B9 would suggest that silicon may not have much contribution to hardness either. Thus, the additional hardness of alloys B1 and B9 as opposed to B02 appears to result from the addition of C and/or B. C is well recognized to contribute to hardness of alloys through carbide formation. B is added to these alloys to enhance their ductility. Thus, it is reasonable to conclude that the high hardness of the alloys of the present invention comes primarily from the addition of aluminum to NiMo and is further increased by the addition of carbon.

The mechanism by which aluminum contributes to hardness may be due to precipitation of fine $Ni_3Al$ (commonly known as γ prime phase) precipitates in a matrix of NiMo. Further increase of hardness in the final alloy is contemplated to be from the precipitation of chromium carbides or possibly some molybdenum carbide. The hardness data after various thermal exposures have shown that the hardness values of the alloys of the present invention are very stable.

Die Block Testing of Alloy B13

Figure 33:
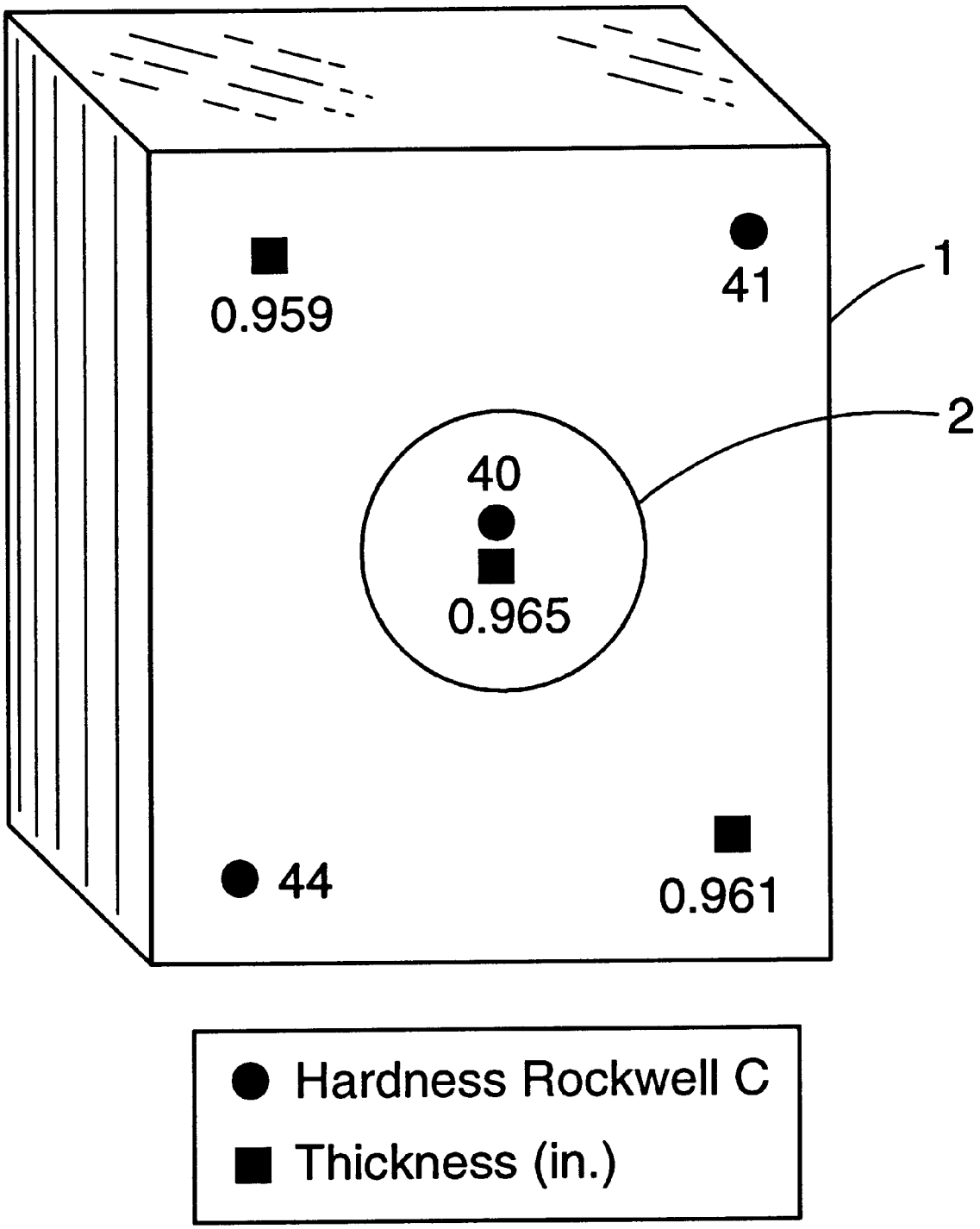
FIG. 33 is a schematic of a cast test die block 1 of alloy B13 which shows the forging area 2, thickness, and hardness of the die block.

Based on hardness, oxidation resistance, tensile properties described herein, alloy B 13 was considered as a preferable alloy for forging die application testing. A 15-lb heat of alloy B13 was air-induction melted and cast into a 4-×6-×1-in. slab. The initial thickness of the slab and hardness are shown in FIG. 33. The slab was used to hot forge 90 cylindrical specimens of mild steel, which were heated to 1100° C. in air. All of the cylinders were reduced by 50% in height. No observable oxidation, change in thickness of the slab, or hardness were observed. Based on these results, it is believed that alloy B 13 has a preferred combination of properties for die applications.

The alloys of the present invention fare most suitable for forging and extrusion dies. Other applications include cutting tools and blades.

Advantages of the invention include:

1. The alloys of the present invention are characterized by high as-cast hardness. Expensive normalizing and/or tempering treatments are not necessary for the alloys of the present invention to achieve their characteristic hardness.
2. The alloys of the present invention require no ingot casting and processing to die block but can be used in the as-cast condition.
3. The alloys of the present invention can be air melted and cast to net or near-net shape and, thus, minimizes the need for machining.
4. Hardness of the alloys of the present invention is retained after repeated exposure to high temperature. In fact, hardness slightly increases with exposure rather than the softening of conventional materials.
5. The alloys of the present invention are characterized by resistance to oxidation, thus, dimensional control is maintained even after repeated exposure to high temperature processes in air.
6. The alloys of the present invention are characterized by high yield strength of 100 ksi even at 800° C., as opposed to very low values for conventional materials.

7. The alloys of the present invention are characterized by good ductility at room temperature and 800° C.

While there has been shown and described what are at present considered the preferred embodiments of the invention, it will be obvious to those skilled in the art that various changes and modifications can be made therein without departing from the scope of the inventions defined by the appended claims.

TABLE 1

Nominal chemical compositions in weight % of Hastelloy B and "B alloys" (B1 through B13)

| | Ni | Co | Cr | Mo | Fe | Si | Mn | C | B | Al |
|---|---|---|---|---|---|---|---|---|---|---|
| B[a] | 62.45 | 2.50 | 1.00 | 26.00 | 6.00 | 1.00 | 1.00 | 0.05 | — | — |
| B1[a] | 60.43 | — | — | 26.00 | 8.00 | 1.00 | — | 0.05 | 0.02 | 4.50 |
| B2[a] | 57.93 | — | — | 26.00 | 8.00 | — | — | 0.05 | 0.02 | 8.00 |
| B3[b] | 60.43 | — | — | 26.00 | 8.00 | 1.00 | — | 0.05 | 0.02 | 4.50 |
| B4[a] | 65.43 | — | — | 21.00 | 8.00 | 1.00 | — | 0.05 | 0.02 | 4.50 |
| B5[a] | 55.43 | — | — | 31.00 | 8.00 | 1.00 | — | 0.05 | 0.02 | 4.50 |
| B6[a] | 61.43 | — | — | 26.00 | 8.00 | 1.00 | — | 0.05 | 0.02 | 3.50 |
| B7[a] | 58.93 | — | — | 26.00 | 8.00 | 1.00 | — | 0.05 | 0.02 | 6.00 |
| B8[a] | 66.93 | — | — | 26.00 | — | 1.00 | — | 0.05 | 0.02 | 6.00 |
| B9[a] | 61.43 | — | 8.00 | 26.00 | — | — | — | 0.05 | 0.02 | 4.50 |
| B10[a] | 65.43 | — | 8.00 | 23.00 | — | — | — | 0.05 | 0.02 | 3.50 |
| B11[a] | 59.93 | — | 8.00 | 26.00 | — | — | — | 0.05 | 0.02 | 6.00 |
| B12[a] | 62.93 | — | 8.00 | 23.00 | — | — | — | 0.05 | 0.02 | 6.00 |
| B13[a,b] | 69.43 | — | 8.00 | 18.00 | — | — | — | 0.05 | 0.02 | 4.50 |

[a]Nonconsumable arc-melted 1 lb and cast into 0.5- × 1- × 5-in. copper mold.
[b]Air-induction-melted 5 lb and cast into 2⅞-in.-diam graphite mold

TABLE 2

Target and check weight percent analysis of selected alloys prepared by arc melting and air induction melting

| | B1 (Arc melted) | | B3 (air-induction melted) | | B1 Air-induction melted) | |
|---|---|---|---|---|---|---|
| | Target | Check | Target | Check | Target | Check |
| Ni | 60.43 | — | 60.43 | — | 60.43 | — |
| Mo | 26.00 | 25.3 | 26.00 | 24.9 | 26.00 | 25.5 |
| Fe | 8.00 | 8.25 | 8.00 | 8.40 | 8.00 | 8.27 |
| Si | 1.00 | 1.02 | 1.00 | 1.16 | 1.00 | 1.03 |
| C | 0.05 | 0.059 | 0.05 | 0.11 | 0.05 | 0.061 |
| B | 0.02 | — | 0.02 | — | 0.02 | — |
| Al | 4.50 | 4.61 | 4.50 | 4.48 | 4.50 | 4.28 |
| Mn | — | 0.01 | — | 0.01 | — | <0.01 |
| S | — | <0.001 | — | <0.001 | — | 0.002 |
| Cr | — | 0.01 | — | 0.01 | — | <0.001 |
| V | — | 0.01 | — | 0.02 | — | 0.01 |
| Cb | — | <0.01 | — | <0.01 | — | <0.01 |
| Ti | — | 0.01 | — | 0.04 | — | 0.01 |
| Co | — | 0.01 | — | 0.1 | — | 0.01 |
| Cu | — | 0.04 | — | 0.04 | — | 0.05 |
| Zr | — | <0.01 | — | <0.01 | — | <0.01 |
| O | — | <0.001 | — | 0.005 | — | 0.001 |
| N | — | 0.004 | — | 0.003 | — | 0.001 |

TABLE 3

Hardness data (room temperature Rockwell C) of B-alloys in as-cast condition and after exposure in air at 850° C.

| | Exposure time (h) | | | | | | | | |
|---|---|---|---|---|---|---|---|---|---|
| | 0 | 10 | 20 | 50 | 100 | 150 | 200 | 250 | 300 |
| B | 22 | 27 | 31 | 33.5 | 34.5 | 35.0 | 34.0 | 34.0 | 34.0 |
| B1 | 56 | 56 | 56 | 55 | 53.5 | 53.0 | 53.2 | 52.5 | 52.0 |
| B2 | 50 | 50 | 50 | 50 | 50 | 50 | 49.5 | 48.0 | 47.0 |

TABLE 3-continued

Hardness data (room temperature Rockwell C) of B-alloys in as-cast condition and after exposure in air at 850° C.

| | Exposure time (h) | | | | | | | | |
|---|---|---|---|---|---|---|---|---|---|
| | 0 | 10 | 20 | 50 | 100 | 150 | 200 | 250 | 300 |
| B3 | — | — | — | — | — | — | — | — | — |
| B4 | 52 | 51.5 | 51.0 | 50.5 | 49.5 | 49.0 | — | — | — |
| B5 | 58 | 56.8 | 55.5 | 55.0 | 55.0 | 55.0 | — | — | — |
| B6 | 55 | 54.5 | 54.1 | 53.1 | 51.7 | 51.0 | — | — | — |
| B7 | 59 | 57.2 | 55.6 | 55.0 | 55.0 | 53.7 | — | — | — |
| B8 | 57 | 56.8 | 56.6 | 55.9 | 54.4 | 53.0 | 53.0 | — | — |
| B9 | 56 | 56.0 | 56.0 | 56.0 | 55.7 | 55.0 | 55.0 | — | — |
| B10 | 43 | 43.8 | 44.5 | 46.7 | 49.7 | 49.0 | 49.0 | — | — |
| B11 | 57 | 57.0 | 57.0 | 57.0 | 56.7 | 56.0 | 56.0 | — | — |
| B12 | 56 | 55.9 | 55.8 | 55.5 | 54.7 | 54.0 | 54.0 | — | — |
| B13 | 40 | 40.5 | 41.0 | 42.0 | 44.0 | 45.0 | 45.0 | — | — |

TABLE 4

Hardness data (room temperature Rockwell C) of B-alloys in as-cast condition and after exposure in air at 900° C.

| | Exposure time (h) | | | | | | |
|---|---|---|---|---|---|---|---|
| | 0 | 10 | 20 | 50 | 100 | 150 | 200 |
| B | 22 | 27 | 32 | 34 | 34 | 34 | — |
| B1 | 56 | 55.5 | 54.2 | 52.0 | 52.0 | 52.0 | — |
| B2 | 50 | 48.5 | 47.5 | 47.0 | 44.0 | 43.0 | — |
| B3 | 51 | 51.5 | 52.0 | 51.0 | 51.0 | 50.0 | — |
| B4 | 52 | 51.5 | 51.2 | 47.9 | 47.0 | 47.0 | — |
| B5 | 59 | 58.2 | 57.2 | 57.0 | 56.5 | 55.4 | — |
| B6 | 55 | 53.6 | 53.1 | 52.0 | 49.8 | 49.2 | — |
| B7 | 57 | 56.0 | 55.2 | 54.0 | 54.0 | 54.0 | — |
| B8 | 57 | 56.7 | 56.3 | 55.3 | 53.7 | 52.9 | 52.2 |
| B9 | 56 | 56.8 | 56.6 | 56.0 | 54.7 | 53.9 | 53.2 |
| B10 | 43 | 43.4 | 43.9 | 45.2 | 46.7 | 45.9 | 45.0 |

TABLE 4-continued

Hardness data (room temperature Rockwell C) of B-alloys in as-cast condition and after exposure in air at 900° C.

| | Exposure time (h) | | | | | | |
|---|---|---|---|---|---|---|---|
| | 0 | 10 | 20 | 50 | 100 | 150 | 200 |
| B11 | 57 | 56.8 | 56.6 | 55.9 | 54.6 | 54.0 | 54.0 |
| B12 | 56 | 55.5 | 55.o | 53.3 | 51.0 | 51.0 | 51.0 |
| B13 | 40 | 41.0 | 42.0 | 42.0 | 42.0 | 42.0 | 42.0 |

TABLE 5

Hardness data (room temperature Rockwell C) of B-alloys in as-cast condition and after exposure in air at 950° C.

| | Exposure time (h) | | | | | |
|---|---|---|---|---|---|---|
| | 0 | 10 | 20 | 50 | 100 | 150 |
| B | 22 | 26.5 | 31.0 | 33.0 | 33.0 | 33.0 |
| B1 | 56 | 55 | 54.2 | 52.0 | 51.2 | 51.2 |
| B2 | 50 | 49 | 48.2 | 46.0 | 44.0 | 43.0 |
| B3 | 51 | 51 | 51 | 51 | 50.2 | 50.0 |
| B4 | 52 | 50.8 | 49.5 | 47.0 | 46.4 | 45.7 |
| B5 | 61 | 59.3 | 57.8 | 54.0 | 54.0 | 53.6 |
| B6 | 55 | 53.3 | 51.8 | 50.0 | 48.3 | 47.0 |
| B7 | 57 | 56.1 | 55.2 | 53.0 | 52.5 | 51.6 |

TABLE 6

Hardness data (room temperature Rockwell C) of B alloys in as-cast condition and after exposure in air at 1000° C.

| | Exposure time (h) | | | | | | |
|---|---|---|---|---|---|---|---|
| | 0 | 10 | 20 | 50 | 100 | 150 | 200 |
| B | 22 | 25 | 28 | 29.4 | 30.0 | 30.0 | — |
| B1 | 56 | 54.8 | 53.5 | 52.0 | 49.8 | 47.8 | — |
| B1[a] | 49.5 | — | 50 | 49 | 48 | 48 | 47.3 |
| B2 | 50 | 46.9 | 43.2 | 40.6 | 37.8 | 35.0 | — |
| B3[a] | 49 | — | 49.5 | 48.3 | 47.0 | 46.7 | 46.5 |
| B4 | 52 | 49.5 | 47.0. | 44.0 | 44.0 | 44.0 | — |
| B5 | 58 | 57 | 55 | 52.0 | 51.7 | 51.2 | — |
| B6 | 55 | 52.2 | 50.6 | 49.0 | 48.3 | 47.3 | — |
| B7 | 59 | 55.2 | 53.7 | 51.0 | 50.8 | 50.2 | — |
| B8 | 57 | 56.0 | 55.3 | 52.6 | 48.7 | 48.0 | 48.0 |
| B9 | 56 | 55.3 | 54.6 | 52.2 | 49.0 | 48.9 | 48.0 |
| B10 | 43 | 43.3 | 43.6 | 44.6 | 46.0 | 45.9 | 45.2 |
| B11 | 57 | 56.4 | 55.7 | 53.7 | 51.0 | 50.7 | 49.3 |
| B12 | 56 | 55.4 | 54.7 | 52.7 | 50.0 | 47.0 | 47.0 |
| B13 | 40 | 41.0 | 42.0 | 42.0 | 42.0 | 42.0 | 42.0 |

[a]Air-induction melted 2-3/4-in.-diam ingot. All other heats are arc melted.

| | 300 | 400 | 500 | 600 | 700 | 800 | 900 |
|---|---|---|---|---|---|---|---|
| B | — | — | — | — | — | — | — |
| B1 | — | — | — | — | — | — | — |
| B1[a] | 46.0 | 45.3 | 45.0 | 45.1 | — | — | — |
| B2 | — | — | — | — | — | — | — |
| B3[a] | 45.8 | 45.1 | 43.4 | 42.2 | 42.2 | 42.2 | 43.0 |
| B4 | — | — | — | — | — | — | — |
| B5 | — | — | — | — | — | — | — |
| B6 | — | — | — | — | — | — | — |
| B7 | — | — | — | — | — | — | — |
| B8 | — | — | — | — | — | — | — |
| B9 | — | — | — | — | — | — | — |
| B10 | — | — | — | — | — | — | — |
| B11 | — | — | — | — | — | — | — |
| B12 | — | — | — | — | — | — | — |
| B13 | — | — | — | — | — | — | — |

[a]Air-induction melted 2-3/4-in.-diam ingot. All other heats are arc melted.

TABLE 7

Weight change due to oxidation (mg/gm) of B alloys in as-cast condition and after exposure in air at 850° C.

| | Exposure time (h) | | | | | | | |
|---|---|---|---|---|---|---|---|---|
| | 10 | 20 | 50 | 100 | 150 | 200 | 250 | 300 |
| B | −0.3 | −0.8 | −1.9 | −4.8 | −6.5 | −9.0 | −10.4 | −12.25 |
| B1 | 0 | 0 | 0 | 0 | 0 | −0.6 | −0.8 | −1.4 |
| B2 | 0 | 0 | 0 | −1.0 | −1.45 | −3.0 | −3.6 | −4.6 |
| B3 | — | — | — | — | — | — | — | — |
| B4 | — | 0 | −0.17 | −0.43 | −0.55 | — | — | — |
| B5 | — | 0 | −0.18 | −0.50 | −1.21 | — | — | — |
| B6 | — | 0 | 0 | 0 | −0.72 | — | — | — |
| B7 | — | 0 | −0.1 | −0.25 | −0.51 | — | — | — |
| B8 | — | — | — | 0 | −0.05 | −0.31 | — | — |
| B9 | — | — | — | 0 | −0.05 | −0.28 | — | — |
| B10 | — | — | — | +0.19 | +0.14 | −0.13 | — | — |
| B11 | — | — | — | +0.35 | +0.30 | +0.07 | — | — |
| B12 | — | — | — | +0.34 | 0 | 0 | — | — |
| B13 | 0 | 0 | 0 | 0 | 0 | 0 | — | — |

TABLE 8

Weight change due to oxidation (mg/gm) of B alloys in as-cast condition and after exposure in air at 900° C.

| | Exposure time (h) | | | | | |
|---|---|---|---|---|---|---|
| | 10 | 20 | 50 | 100 | 150 | 200 |
| Hastelloy B[a] | — | −3.3 | −8.5 | −13.2 | −19.5 | — |
| B | — | −0.9 | −3.3 | −6.2 | −10.5 | — |
| B1 | — | 0 | 0 | −0.2 | −1.7 | — |
| B2 | — | | −0.3 | −0.6 | −1.2 | — |
| B3 | — | 0 | 0 | 0 | 0 | — |
| B4 | — | −0.22 | −0.60 | −0.62 | −0.80 | — |
| B5 | — | −1.38 | −2.41 | −3.70 | −4.62 | — |
| B6 | — | o | −0.03 | −0.82 | −1.35 | — |
| B7 | — | o | 0 | −0.1 | −0.25 | — |
| B8 | — | — | — | +0.3 | −0.1 | −0.3 |
| B9 | — | — | — | +0.3 | +0.25 | −0.25 |
| B10 | — | — | — | −0.2 | −1.2 | −2.3 |
| B11 | — | — | — | 0 | 0 | — |
| B12 | — | — | — | 0 | 0 | 0 |
| B13 | 0 | 0 | 0 | 0 | 0 | 0 |

[a]Data on commercially processed wrought Hastelloy B is also included for comparison

TABLE 9

Weight change due to oxidation (mg/gm) of B alloys in as-cast condition and after exposure in air at 950° C.

| | Exposure time (h) | | | | |
|---|---|---|---|---|---|
| | 10 | 20 | 50 | 100 | 150 |
| Hastelloy B[a] | — | −2.7 | −8.2 | −14.5 | −25.0 |
| B | — | −1.0 | −4.6 | −8.2 | −14.5 |
| B1 | — | 0 | −0.2 | −0.9 | −2.0 |
| B2 | — | 0 | 0.1 | −0.7 | −1.0 |
| B3 | — | 0 | 0.2 | +3.2 | +3.0 |
| B4 | — | +0.7 | +0.25 | +0.2 | −0.2 |
| B5 | — | −2.7 | −3.4 | −4.25 | −5.45 |
| B6 | — | +0.3 | 0 | −0.5 | −1.1 |
| B7 | — | 0 | −0.3 | −0.35 | −0.35 |

[a]Data on commercially processed wrought Hastelloy B is also included for comparison

TABLE 10

Weight change due to oxidation (mg/gm) of B alloys in as-cast condition and after exposure in air at 1000° C.

| | Exposure time (h) | | | | | |
|---|---|---|---|---|---|---|
| | 10 | 20 | 50 | 100 | 150 | 200 |
| B | — | −3.0 | −7.0 | −14.0 | −24.1 | — |
| B1 | — | 0 | −0.7 | −1.9 | −4.0 | — |
| B2 | — | −0.5 | −1.2 | −2.8 | −4.0 | — |
| B3 | — | — | — | — | — | — |
| B4 | — | +0.3 | −0.3 | 0 | −0.6 | — |
| B5 | — | 0 | −2.6 | −5.6 | −7.7 | — |
| B6 | — | −1.6 | −3.7 | −7.0 | −9.0 | — |
| B7 | — | 0 | 0 | 0 | −0.25 | — |
| B8 | — | — | — | −1.15 | −2.25 | −3.15 |
| B9 | — | — | — | −0.4 | −1.0 | −1.25 |
| B10 | — | — | — | +0.2 | +0.2 | 0 |
| B11 | — | — | — | +0.35 | +0.30 | +0.05 |
| B12 | — | — | — | 0 | +0.05 | +0.35 |
| B13 | 0 | 0 | 0 | 0 | 0 | 0 |

TABLE 11

Rockwell C Hardness data of B alloys with systematic addition of alloying elements

| | Weight percent | | | | | | | | |
|---|---|---|---|---|---|---|---|---|---|
| | Ni | Mo | Cr | Al | Fe | Si | C | B | Hardness |
| B0 | 74 | 26 | | | | | | | 10 |
| B01 | 66 | 26 | 8 | | | | | | 9 |
| B02 | 69.5 | 26 | — | 4.5 | | | | | 49 |
| B1 | 60.43 | 26 | — | 4.5 | 8 | 1 | 0.05 | 0.02 | 56 |
| B9 | 61.43 | 26 | 8 | 4.5 | — | — | 0.05 | 0.02 | 56 |

TABLE 12

Tensile properties of alloy B9

| Specimen No. | Test Temperature | Heat Treatment | Yield | Tensile | Total Elongation | Reduction of Area |
|---|---|---|---|---|---|---|
| 1L | 23° C. | As cast | 125.38ksi | 125.38ksi | 0.28% | 0.00% |
| 2L | 800° C. | As cast | 42.61ksi | 42.61ksi | 0.27% | 0.00% |
| 3L | 800° C. | As cast | 46.92ksi | 46.92ksi | 0.24% | 0.00% |

Strain rate: 0.16 in/in/min

TABLE 13

Tensile Properties of alloy B13

| Specimen No. | Test Temperature | Heat Treatment | Yield | Tensile | Total Elongation | Reduction of Area |
|---|---|---|---|---|---|---|
| 1L | 23 | As cast | 131.21 | 153.54 | 7.70 | 7.62 |
| 2L | 800 | As cast | 100.27 | 126.61 | 4.24 | 17.65 |

Strain rate: 0.16 in/in/min

What is claimed is:

1. A polycrystalline alloy consisting essentially of, by weight %: 15% to 30% Mo, 3% to 10% Al, up to 10% Cr, up to 10% Fe, up to 2% Si, 0.01% to 0.2% C, 0.01% to 0.04% B, balance Ni.

2. An alloy in accordance with claim 1 further consisting essentially of, by weight %: about 26% Mo, about 4.5% Al, about 8% Fe, about 1% Si, about 0.05% C, about 0.02% B, balance Ni.

3. An alloy in accordance with claim 1 further consisting essentially of, by weight %: about 26% Mo, about 8% Al, about 8% Fe, about 0.05% C, about 0.02% B, balance Ni.

4. An alloy in accordance with claim 1 further consisting essentially of, by weight %: about 21% Mo, about 4.5% Al, about 8% Fe, about 1% Si, about 0.05% C, about 0.02% B, balance Ni.

5. An alloy in accordance with claim 1 further consisting essentially of, by weight %: about 31% Mo, about 4.5% Al, about 8% Fe, about 1% Si, about 0.05% C, about 0.02% B, balance Ni.

6. An alloy in accordance with claim 1 further consisting essentially of, by weight %: about 26% Mo, about 3.5% Al, about 8% Fe, about 1% Si, about 0.05% C, about 0.02% B, balance Ni.

7. An alloy in accordance with claim 1 further consisting essentially of, by weight %: about 26% Mo, about 6% Al, about 8% Fe, about 1% Si, about 0.05% C, about 0.02% B, balance Ni.

8. An alloy in accordance with claim 1 further consisting essentially of, by weight %: about 26% Mo, about 6% Al, about 1% Si, about 0.05% C, about 0.02% B, balance Ni.

9. An alloy in accordance with claim 1 further consisting essentially of, by weight %: about 26% Mo, about 4.5% Al, about 8% Cr, about 0.05% C, about 0.02% B, balance Ni.

10. An alloy in accordance with claim 1 further consisting essentially of, by weight %: about 23% Mo, about 3.5% Al, about 8% Cr, about 0.05% C, about 0.02% B, balance Ni.

11. An alloy in accordance with claim 1 further consisting essentially of, by weight %: about 26% Mo, about 6% Al, about 8% Cr, about 0.05% C, about 0.02% B, balance Ni.

12. An alloy in accordance with claim 1 further consisting essentially of, by weight %: about 23% Mo, about 6% Al, about 8% Cr, about 0.05% C, about 0.02% B, balance Ni.

13. An alloy in accordance with claim 1 further consisting essentially of, by weight %: about 18% Mo, about 4.5% Al, about 8% Cr, about 0.05% C, about 0.02% B, balance Ni.

14. A polycrystalline alloy consisting essentially of, by weight %: 15% to 23% Mo, 3% to 6% Al, 7% to 9% Cr, 0.03% to 0.1% C, 0.01% to 0.04% B, balance Ni.

15. An alloy in accordance with claim 14 further consisting essentially of, by weight %: 16% to 21% Mo, 4% to 5% Al, 7% to 9% Cr, 0.03% to 0.1% C, 0.01% to 0.04% B, balance Ni.

16. A polycrystalline alloy consisting essentially of, by weight %: 15% to 30% Mo, 3% to 10% Al, up to 10% of an element selected from the group consisting of Cr and Fe, up to 2% Si, 0.01% to 0.2% C, 0.01% to 0.04% B, balance Ni.

* * * * *